US011371221B2

(12) United States Patent
McCaffrey et al.

(10) Patent No.: US 11,371,221 B2
(45) Date of Patent: Jun. 28, 2022

(54) GROUND ENGAGING TOOL ASSEMBLY WITH GROUND ENGAGING TIP

(71) Applicant: Caterpillar Inc., Deerfield, IL (US)

(72) Inventors: Brandon H. McCaffrey, Peoria, IL (US); Mihai M. Balan, Oro Valley, AZ (US)

(73) Assignee: Caterpillar Inc., Peoria, IL (US)

( * ) Notice: Subject to any disclaimer, the term of this patent is extended or adjusted under 35 U.S.C. 154(b) by 537 days.

(21) Appl. No.: 16/393,458

(22) Filed: Apr. 24, 2019

(65) Prior Publication Data

US 2020/0340217 A1 Oct. 29, 2020

(51) Int. Cl.
*E02F 9/28* (2006.01)

(52) U.S. Cl.
CPC ..... *E02F 9/2825* (2013.01); *E02F 9/2841* (2013.01); *E02F 9/2891* (2013.01)

(58) Field of Classification Search
CPC ..... E02F 9/2816; E02F 9/2825; E02F 9/2858
See application file for complete search history.

(56) References Cited

U.S. PATENT DOCUMENTS

| | | | | |
|---|---|---|---|---|
| 6,871,426 | B2 | 3/2005 | Keech et al. | |
| 7,762,015 | B2 * | 7/2010 | Smith | E02F 9/2833 37/455 |
| 8,307,574 | B2 | 11/2012 | Ruvang | |
| 8,327,563 | B2 | 12/2012 | Bingwall et al. | |
| D705,823 | S * | 5/2014 | Haslett | D15/28 |
| 8,832,975 | B2 * | 9/2014 | Itou | E02F 9/2833 37/455 |
| 8,925,221 | B2 * | 1/2015 | Jeske | E02F 9/2891 37/455 |
| 8,997,383 | B2 * | 4/2015 | Itou | E02F 9/2833 37/455 |
| 9,121,160 | B2 * | 9/2015 | Hughes | E02F 9/2841 |
| 9,139,984 | B2 * | 9/2015 | Chenoweth | E02F 9/2833 |
| 9,175,457 | B2 * | 11/2015 | Rimmey | E02F 9/2841 |
| 9,309,651 | B2 * | 4/2016 | Jeske | E02F 9/2841 |

(Continued)

FOREIGN PATENT DOCUMENTS

| | | |
|---|---|---|
| AU | 2013200161 | 4/2015 |
| CN | 105408557 | 3/2016 |

(Continued)

*Primary Examiner* — Gary S Hartmann
(74) *Attorney, Agent, or Firm* — Leydig, Voit & Mayer, Ltd.

(57) ABSTRACT

A ground engaging tool assembly includes a ground engaging tip, an adapter, and a wear cap. The ground engaging tip has a ground engaging portion and a coupling portion including an interior surface defining a coupler pocket with an adapter opening and first and second lug openings. The adapter includes a mounting nose with first and second retention lugs extending from sides of the mounting nose along oblique taper angles. The mounting nose is disposed within the coupler pocket of the ground engaging tip with the first and second retention lugs extending into the first and second lug openings, respectively. The base includes a shoulder surface and a retention surface that define a mounting groove therebetween. The wear cap includes a mounting rail that is disposed within the mounting groove of the adapter to mount the wear cap thereto.

19 Claims, 20 Drawing Sheets

(56) References Cited

U.S. PATENT DOCUMENTS

| | | | | |
|---|---|---|---|---|
| 9,624,651 | B2 | 4/2017 | Renski et al. | |
| 9,670,648 | B2 * | 6/2017 | Kanniappan | E02F 9/2808 |
| 2003/0070330 | A1 * | 4/2003 | Olds | E02F 9/2825 37/456 |
| 2004/0139632 | A1 | 7/2004 | Robinson et al. | |
| 2013/0152433 | A1 | 6/2013 | Itou et al. | |
| 2014/0259811 | A1 | 9/2014 | Ballinger | |
| 2015/0033597 | A1 | 2/2015 | Kunz | |
| 2017/0328036 | A1 | 11/2017 | Bilal et al. | |
| 2018/0080200 | A1 | 3/2018 | Hughes | |

FOREIGN PATENT DOCUMENTS

| | | |
|---|---|---|
| JP | 2012-233379 | * 11/2012 |
| RU | 2664988 | 8/2018 |
| WO | 2014194159 | 12/2014 |

* cited by examiner

GROUND ENGAGING TOOL ASSEMBLY WITH GROUND ENGAGING TIP

TECHNICAL FIELD

This patent disclosure relates generally to ground engaging tools and, more particularly, to ground engaging tools on buckets, blades, and other work tools used with mining and construction machinery.

BACKGROUND

Different types of mining and construction machines, such as excavators, wheel loaders, hydraulic mining shovels, cable shovels, bucket wheels, and draglines commonly employ buckets to dig and remove the earth being worked or materials being excavated or loaded. The buckets frequently experience extreme wear from the loading forces and highly abrasive materials encountered during operation. Replacement of the large buckets and other implements used in mining and construction machinery can be very costly and labor intensive.

The bucket can be equipped with a ground engaging tool (GET) or a set of GETs to help protect the bucket and other earth working tools from wear. Typically, a GET can be in the form of teeth, edge protectors, tips, or other removable components that can be attached to the areas of the bucket or other tool where most damaging and repeated abrasions and impacts occur. For example, a GET in the form of edge protectors can wrap around a bucket's cutting edge to help protect it from excessive wear.

In such applications, the removable GET can be subjected to wear from abrasion and repeated impact, while helping to protect the bucket or other implement to which it can be mounted. When the GET becomes worn through use, it can be removed and replaced with a new GET at a reasonable cost to permit the continued use of the same bucket. By protecting the implement with a GET and replacing the worn GET at appropriate intervals, significant cost and time savings are possible.

A GET can have a variety of forms. For example, U.S. Patent Application Publication No. US2018/0080200 for a "Connection Assembly" is directed to a coupling for connecting ground engaging tools to a lip of an excavator bucket or similar implement that uses an eccentric rotating lock. Rotation of the lock alters the distance between bearing surfaces and thus allows tightening of the lock.

The cost and time savings available from using a GET to protect large machine implements can be further enhanced by increasing the lifespan of the GET. Thus, a more durable GET assembly can result in fewer work stoppages for part replacements, thereby resulting in higher work efficiency. There is an ongoing need in the art for an improved GET assembly that increases the useful life of GET tools resulting in fewer replacements and increased productivity.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

Tip Summary

In one aspect of the present disclosure, there are described embodiments of a ground engaging tip for a machine implement. In one embodiment, the ground engaging tip includes a ground engaging portion and a coupling portion. The coupling portion and the ground engaging portion extend along a longitudinal tip axis.

The coupling portion includes an interior surface defining a coupler pocket having an adapter opening disposed at the coupling portion, a first lug opening, and a second lug opening. The interior surface includes an interior base wall. The coupler pocket extends from the interior base wall to the adapter opening along the longitudinal tip axis. The interior surface includes a first interior face surface and a second interior face surface. The first interior face surface and the second interior face surface converge toward each other in a direction from the adapter opening toward the interior base wall along a normal tip axis. The normal tip axis is perpendicular to the longitudinal tip axis.

The interior surface includes a first interior side surface and a second interior side surface. The first interior side surface and the second interior side surface are in spaced relationship to each other along a transverse tip axis. The transverse tip axis is perpendicular to the longitudinal tip axis and to the normal tip axis. The first interior side surface and the second interior side surface each extends between the first interior face surface and the second interior face surface.

The first interior side surface and the second interior side surface respectively define the first lug opening and the second lug opening. The first lug opening extends along a first lug opening axis, and the second lug opening extends along a second lug opening axis. The first lug opening axis and the longitudinal tip axis define a first lug opening taper angle, and the second lug opening axis and the longitudinal tip axis define a second lug opening taper angle. The first lug opening taper angle and the second lug opening taper angle are both oblique.

In another aspect, the present disclosure describes embodiments of a GET assembly. In one embodiment, the GET assembly includes an adapter and a ground engaging tip.

The adapter includes a base, an implement mounting portion, and a tip mounting portion. The implement mounting portion extends from the base and is configured to be mounted to a machine implement. The tip mounting portion extends from the base in opposing relationship to the implement mounting portion. The tip mounting portion includes a mounting nose, a first retention lug, and a second retention lug.

The mounting nose includes a base end and a distal end. The base end is connected to the base. The mounting nose extends from the base end to the distal end along a longitudinal nose axis. The mounting nose includes a first nose side surface and a second nose side surface. The first nose side surface and the second nose side surface are in spaced relationship to each other along a transverse nose axis. The transverse nose axis is perpendicular to the longitudinal nose axis. The first retention lug extends from the first nose side surface along a first lug axis, and the second retention lug extends from the second nose side surface along a second lug axis. The first lug axis and the longitudinal nose axis define a first lug taper angle, and the second lug axis and the longitudinal nose axis define a second lug taper angle. The first lug taper angle and the second lug taper angle are both oblique.

The ground engaging tip has a coupling portion and a ground engaging portion. The coupling portion and the ground engaging portion extend along a longitudinal tip axis. The coupling portion includes an interior surface defining a coupler pocket having an adapter opening, a first lug opening, and a second lug opening. The mounting nose of the adapter is disposed within the coupler pocket of the ground engaging tip. The first retention lug and the second retention lug project from the mounting nose of the adapter and respectively extend into the first lug opening and the second lug opening of the ground engaging tip.

Further and alternative aspects and features of the disclosed principles will be appreciated from the following detailed description and the accompanying drawings. As will be appreciated, the GETs disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
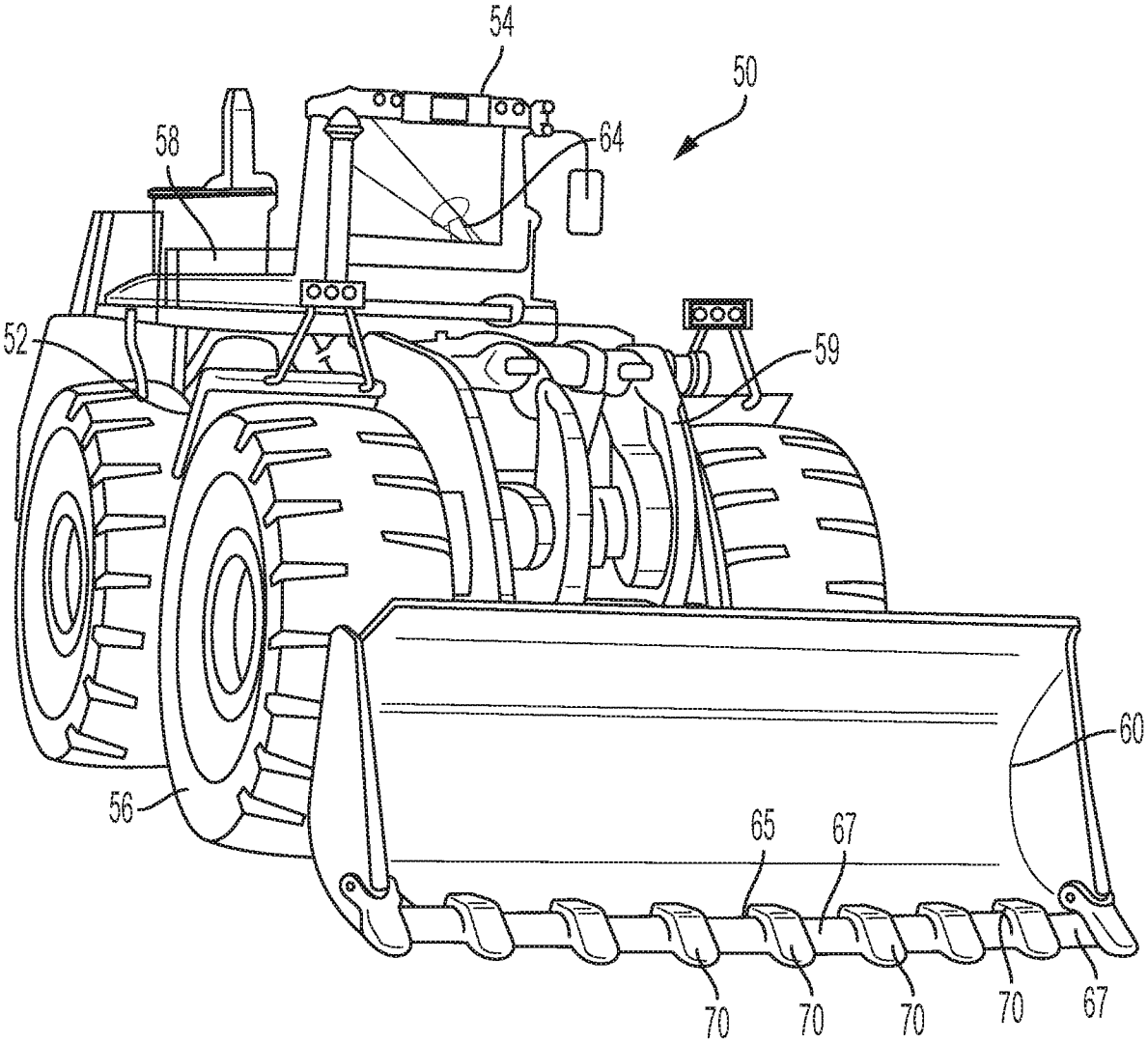
FIG. 1 is a diagrammatic perspective view of an embodiment of a machine including an embodiment of an implement having an embodiment of a GET assembly constructed in accordance with principles of the present disclosure.

This disclosure relates to GET components and assemblies utilized in various types of construction and mining machinery. FIG. 1 shows an embodiment of a machine 50 in the form of a large wheel loader that includes an implement 60, or work tool, in the form of a bucket and equipped with an embodiment of a GET assembly 70 constructed in accordance with principles of the present disclosure.

As shown in FIG. 1, the machine 50 can include a body 52 with a cab 54 to house a machine operator, a plurality of tires 56 to propel the machine 50 over the ground, and a power source 58 (e.g., an internal combustion engine) to drive the tires 56. The machine can also include a linkage system 59 pivotally connected at one end to the body 52 and pivotally supporting the implement 60 at an opposing, distal end. In embodiments, the implement 60 can be any suitable implement, such as a bucket, a clamshell, a blade, or any other type of suitable device usable with GETs.

A control system 64 can be housed in the cab 54 that can be adapted to allow a machine operator to manipulate and articulate the implement 60 for digging, excavating, or any other suitable application. The control system 64 can include a steering system configured to control the movement of the machine 50. In embodiments, the steering system can have a steering wheel or a joystick, or other control mechanism to guide a motion of the machine 50, or parts thereof. Further, the cab 54 can house other control levers, knobs, dials, displays, alarms, etc. to facilitate operation of the machine 50.

The cab 54 can be suitably sized to accommodate a human operator. In other embodiments, the machine 50 can be configured to be controlled remotely from a base station, in which case, the cab 54 can be sized to be smaller or eliminated.

The implement 60 illustrated in FIG. 1 is a bucket. The linkage system 59 is operably arranged with the power source 58 of the machine 50 and the control system 64 so that the bucket 60 can be manipulated to perform operations such as digging into earth, dirt, rock, soil, etc. and hauling material to another location. The linkage system 59 can be operated to lift the bucket 60 into the air and positioned to hold its payload within the bucket while the machine 50 moves to a dump site.

The implement 60 can include a cutting edge 65 that can be adapted to engage the ground or other excavating surface. The cutting edge 65 can have a number of the GET assemblies 70 arranged on the cutting edge 65 such that the GET assemblies 70 contact the working material with the cutting edge 62 in offset relationship to the tips of the GET assemblies 70. Though not clearly discernable in FIG. 1, the GET assemblies 70 have certain features according to various embodiments of the present disclosure, which will be discussed in further detail later herein. A plurality of shrouds 67 can be alternately arranged with the GET assemblies 70 to further protect the portions of the cutting edge 65 not covered by the GET assemblies 70. Through repeated use, the GET assemblies 70 can be subjected to wear and eventually can be replaced to allow the further use of the implement 60.

Although FIG. 1 illustrates the use of a GET assembly 70 constructed in accordance with principles of the present disclosure with a bucket of a wheel loader, many other types of implements and construction and mining machinery can benefit from using a GET assembly 70 as described herein. It should be understood that, in other embodiments, a GET assembly 70 constructed in accordance with principles of the present disclosure can be used in a variety of other implements and/or machines.

Referring to FIGS. 2-10, there is shown an embodiment of a GET assembly 70 constructed according to principles of the present disclosure. The illustrated GET assembly 70 includes an adapter 75, a wear cap 80, a ground engaging tip 90, and a pair of retention mechanisms 95, 96. The adapter 75 can be welded, or otherwise connected as will be appreciated by one skilled in the art, to a bucket or other machine implement 60 to which the GET assembly 70 can be attached. The wear cap 80 can be removably mounted to the adapter 75 via a captured, rail-and-groove arrangement between the wear cap 80 and the adapter 75. The ground engaging tip 90 can be pivotally connected or otherwise mounted to the adapter 75 using the pair of retention mechanisms 95, 96. The pair of retention mechanisms 95, 96 can be respectively disposed on opposing sides of the GET assembly 70 and are configured to removably connect the ground engaging tip 90 to the adapter 75.

Figure 2:
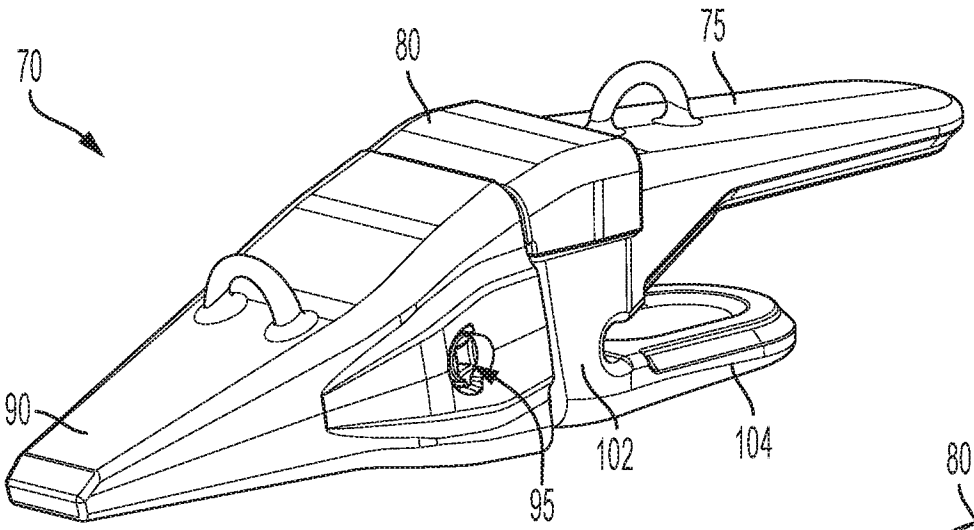
FIG. 2 is a side perspective view of an embodiment of a GET assembly constructed in accordance with principles of the present disclosure.
Figure 3:
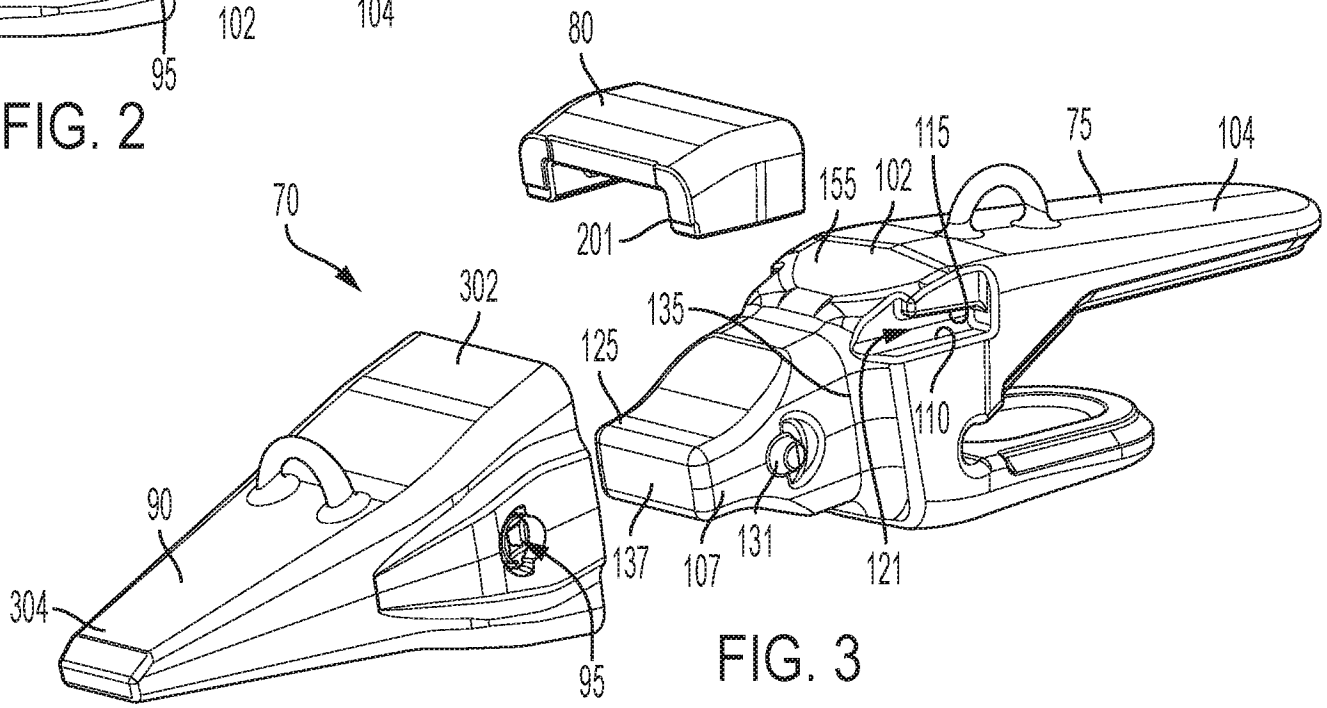
FIG. 3 is a partial exploded view of the GET assembly of FIG. 2.
Figure 4:
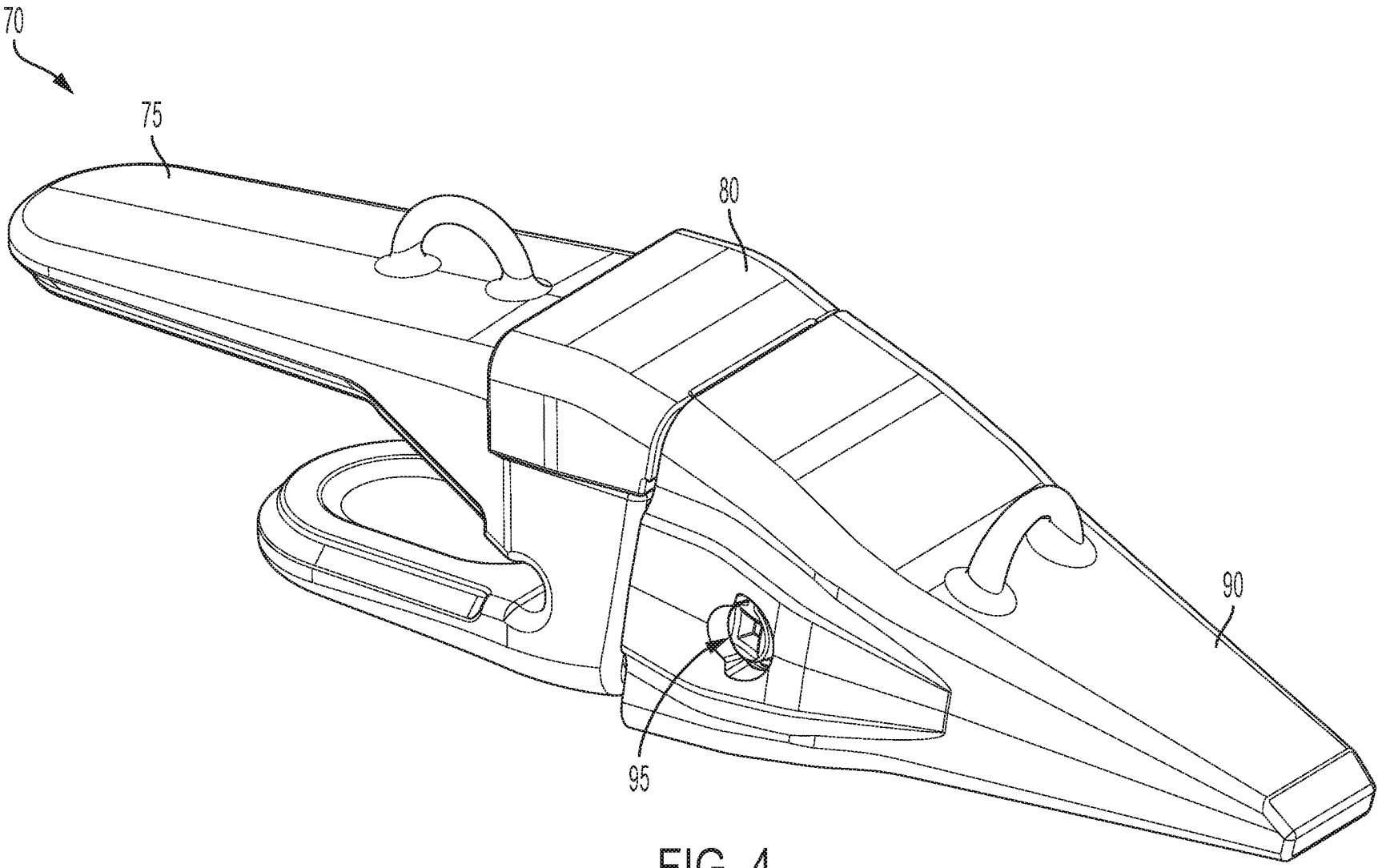
FIG. 4 is an enlarged perspective view of the GET assembly of FIG. 2, viewed from the opposite side as is shown in FIG. 2.
Figure 5:
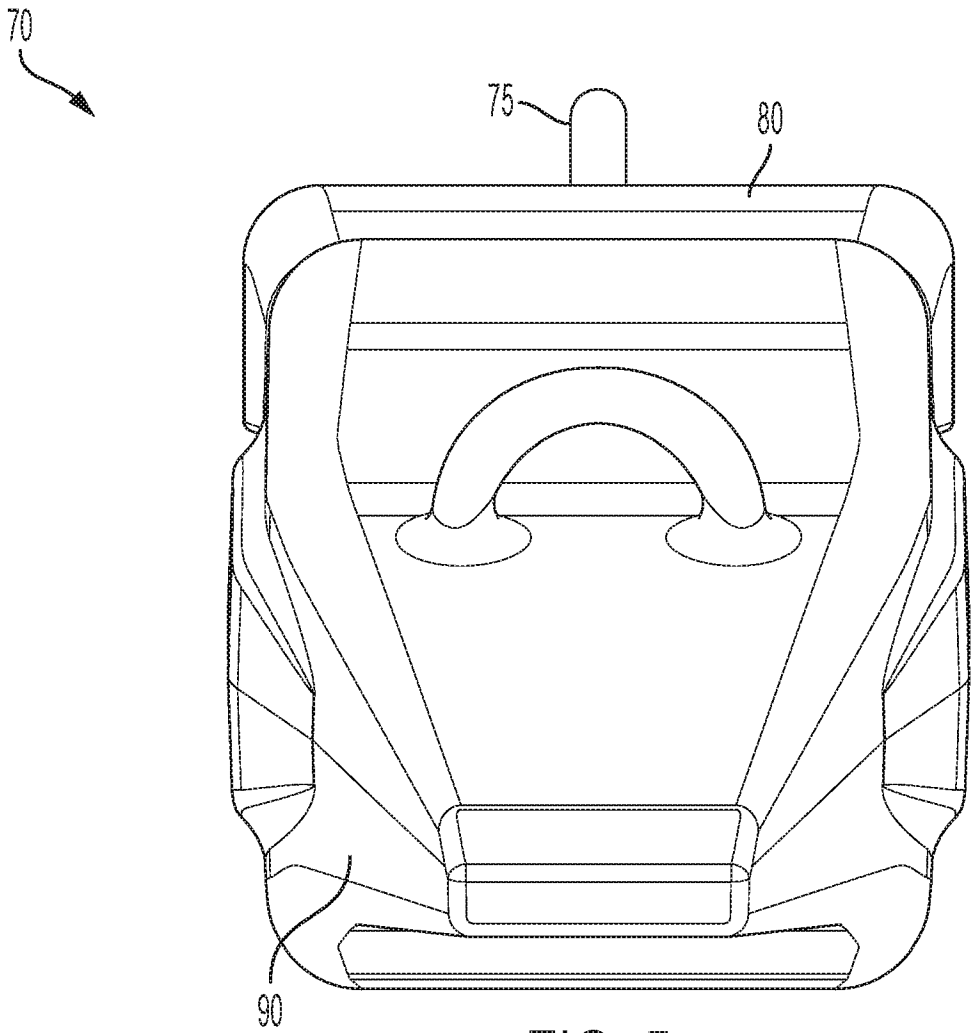
FIG. 5 is an enlarged, tip end elevational view of the GET assembly of FIG. 2.
Figure 6:
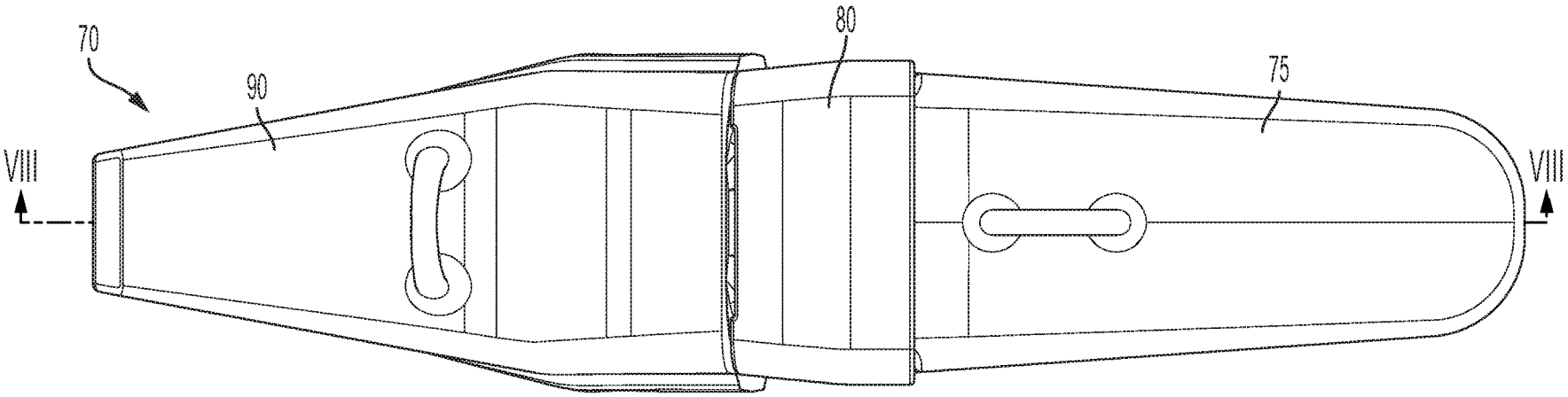
FIG. 6 is a top plan view of the GET assembly of FIG. 2.
Figure 7:
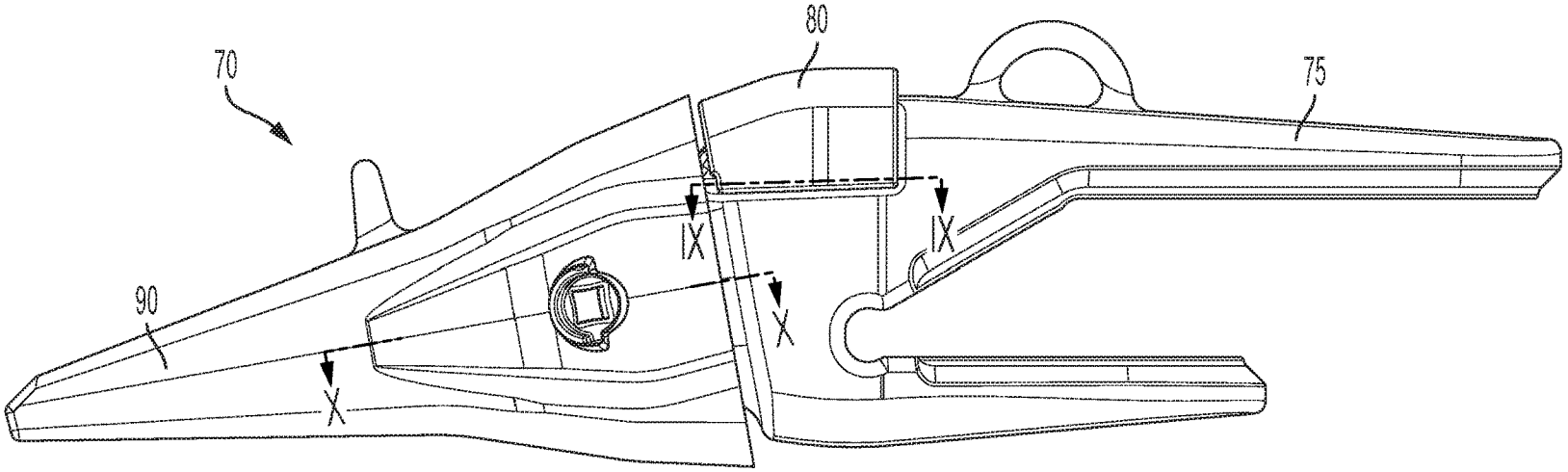
FIG. 7 is a side elevational view of the GET assembly of FIG. 2.
Figure 9:
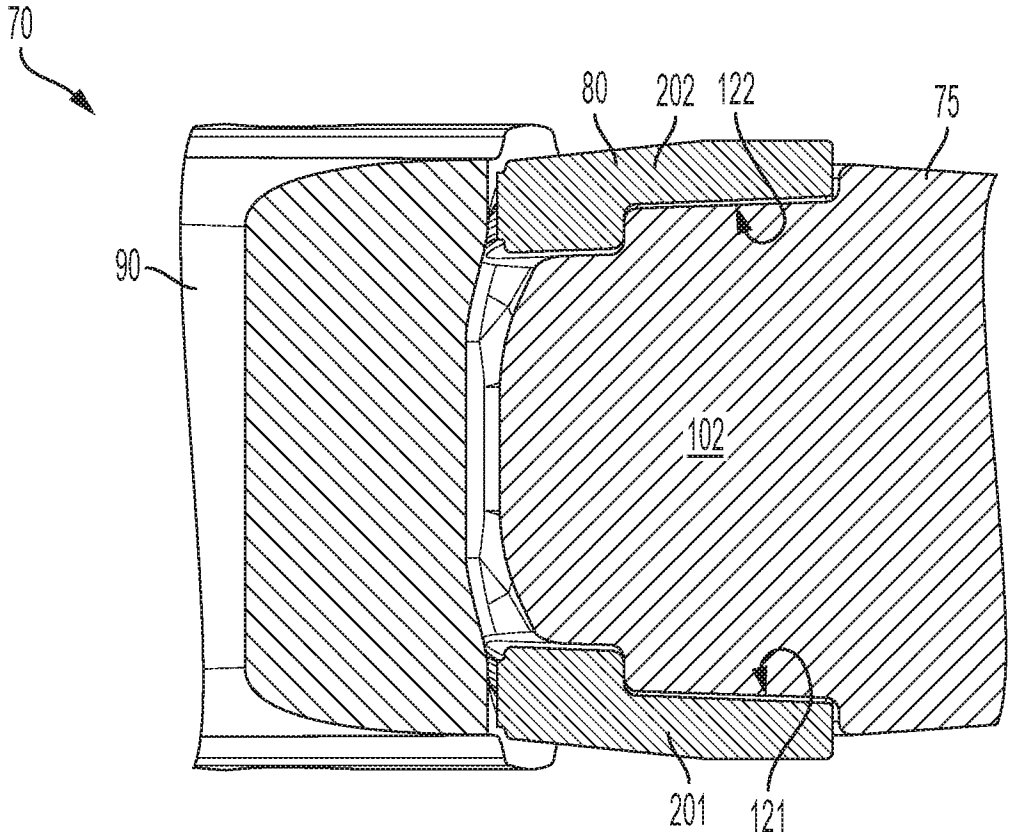
FIG. 9 is a cross-sectional view, taken along line IX-IX in FIG. 7, of the GET assembly of FIG. 2.

Referring to FIGS. 2 and 3, the adapter 75 includes a base 102, an implement mounting portion 104, and a tip mounting portion 107. The implement mounting portion 104 is configured for securing the adapter 75 to the implement 60 and extends from the base 102 and is configured to be mounted to the implement 60 of the machine 50. In embodiments, the base 102 includes at least one shoulder surface 110 and retention surface 115 disposed in offset relationship to each other such that a mounting groove 121 is defined therebetween. The mounting groove 121 is configured to retentively receive therein the wear cap 80 for removably mounting the wear cap 80 to the adapter 75. Referring to FIG. 9, in the illustrated embodiment, the base 102 defines first and second mounting grooves 121, 122.

Referring to FIG. 3, the tip mounting portion 107 is configured for coupling the ground engaging tip 90 to the adapter 75 and extends from the base 102 in opposing relationship to the implement mounting portion 104. The tip mounting portion 107 includes a mounting nose 125, a first retention lug 131, and a second retention lug 132 (see, e.g., FIG. 10). The mounting nose 125 includes a base end 135 and a distal end 137. The base end 135 is connected to the base 102, and the distal end 137 is free.

Referring to FIGS. 2 and 3, the wear cap 80 is mounted to the adapter 75 such that the wear cap 80 is in captured relationship between the adapter 75 and the ground engaging tip 90 such that the ground engaging tip 90 retentively prevents the wear cap 80 from being removed from the mounting groove 121 of the adapter 75. In embodiments, the wear cap 80 includes at least one mounting rail 201. The mounting rail 201 is disposed within the mounting groove 121 of the adapter 75 such that the mounting rail is interposed between the retention surface and the shoulder surface 110 of the adapter 75 to mount the wear cap 80 to the adapter 75. The wear cap 80 is mounted to the adapter 75 such that the wear cap 80 is in captured relationship between the adapter 75 and the ground engaging tip 90 such that the ground engaging tip 90 retentively prevents the mounting rail 201 of the wear cap 80 from being removed from the mounting groove of the adapter 75. Referring to FIG. 9, in the illustrated embodiment, the wear cap 80 includes first and second mounting rails 201, 202 for positioning respectively in the first and second mounting grooves 120, 121 of the adapter 75.

Figure 10:
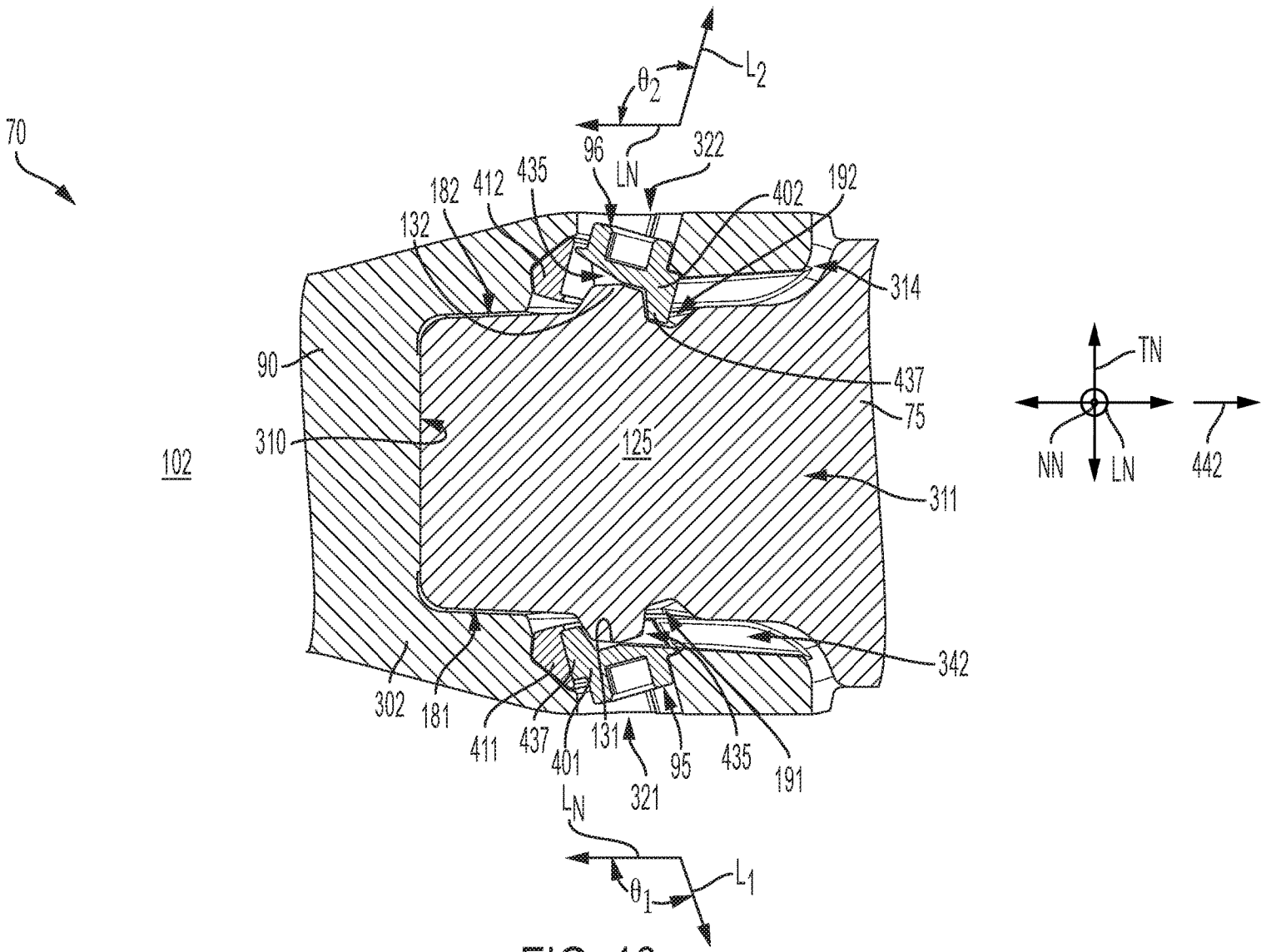
FIG. 10 is a cross-sectional view, taken along line X-X in FIG. 7, of the GET assembly of FIG. 2.

Referring to FIG. 3, the ground engaging tip 90 has a coupling portion 302 and a ground engaging portion 304. Referring to FIG. 10, the coupling portion 302 includes an interior surface 310 defining a coupler pocket 311 having an adapter opening 314, a first lug opening 321, and a second lug opening 321. The mounting nose 125 of the adapter 75 is disposed within the coupler pocket 311 of the ground engaging tip 90. The first retention lug 131 and the second retention lug 132 project from the mounting nose 125 of the adapter 75 and respectively extend into the first lug opening 321 and the second lug opening 322 of the ground engaging tip 90.

Referring to FIG. 10, in the illustrated embodiment, the pair of retention mechanisms 95, 96 can fit into the first and second lug openings 321, 322 of the ground engaging tip 90 and respectively engage with the first and second retention lugs 131, 132 of the adapter 75 to pivotally secure the ground engaging tip 90 to the adapter 75. In the illustrated embodiment, each retention mechanism 95, 96 has substantially the same construction and includes a lug retainer 401, 402 and a locking sleeve 411, 412. Each lug retainer 401 is rotatable with respect to its associated C-shaped locking sleeve 411 and with respect to the retention lug 131, 132 with which it is associated to selectively couple the ground engaging tip 90 to the adapter 75.

Figure 11:
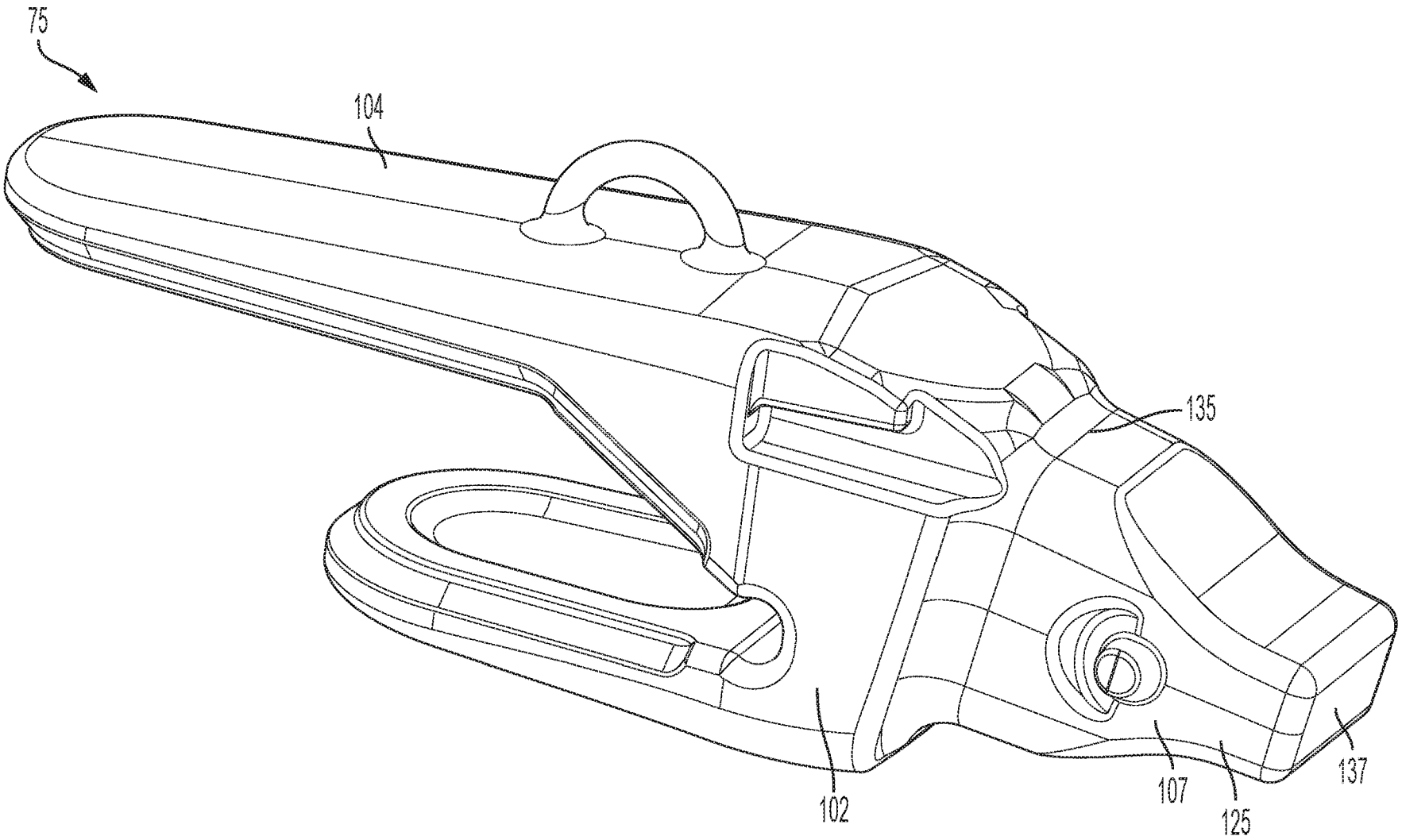
FIG. 11 is a side perspective view of a tip adapter of the GET assembly of FIG. 2.
Figure 12:
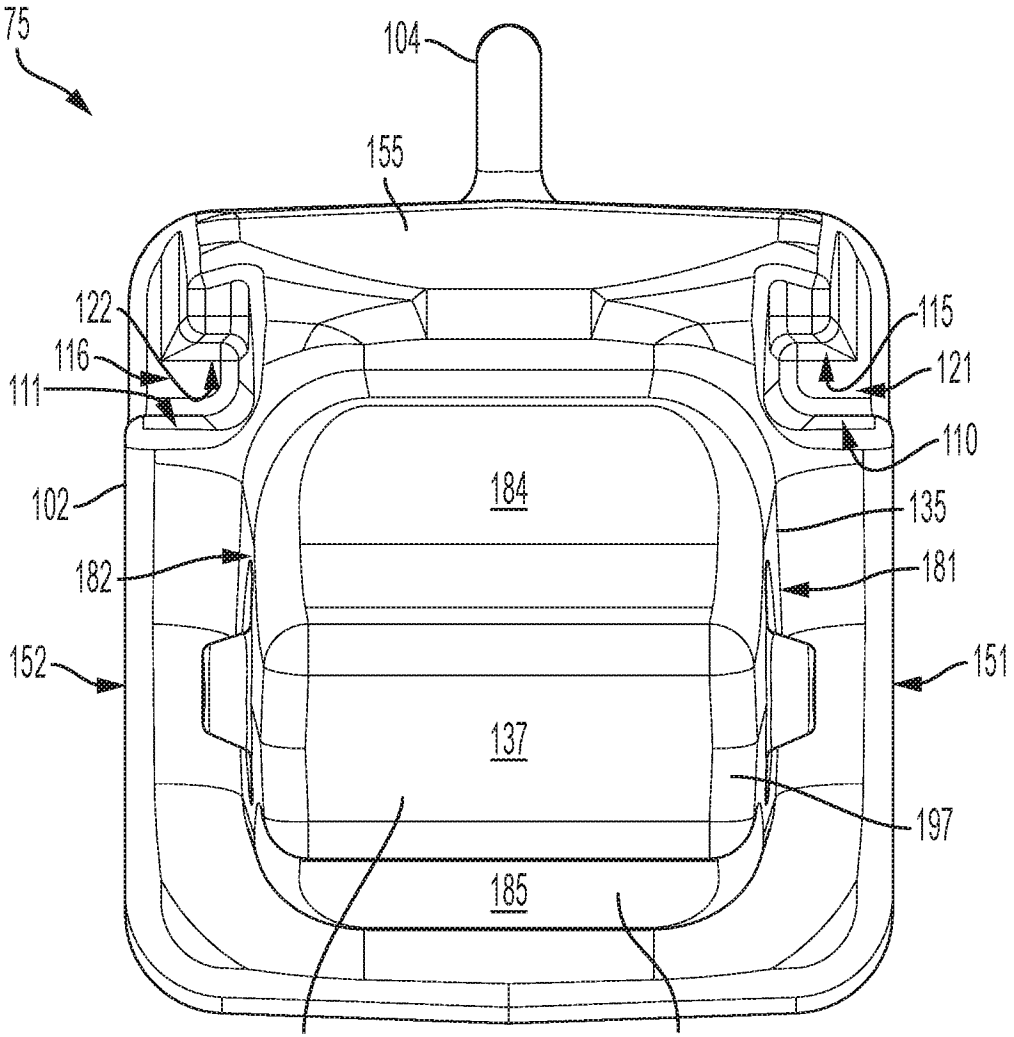
FIG. 12 is an enlarged, distal end elevational view of the tip adapter of FIG. 11.
Figure 13:
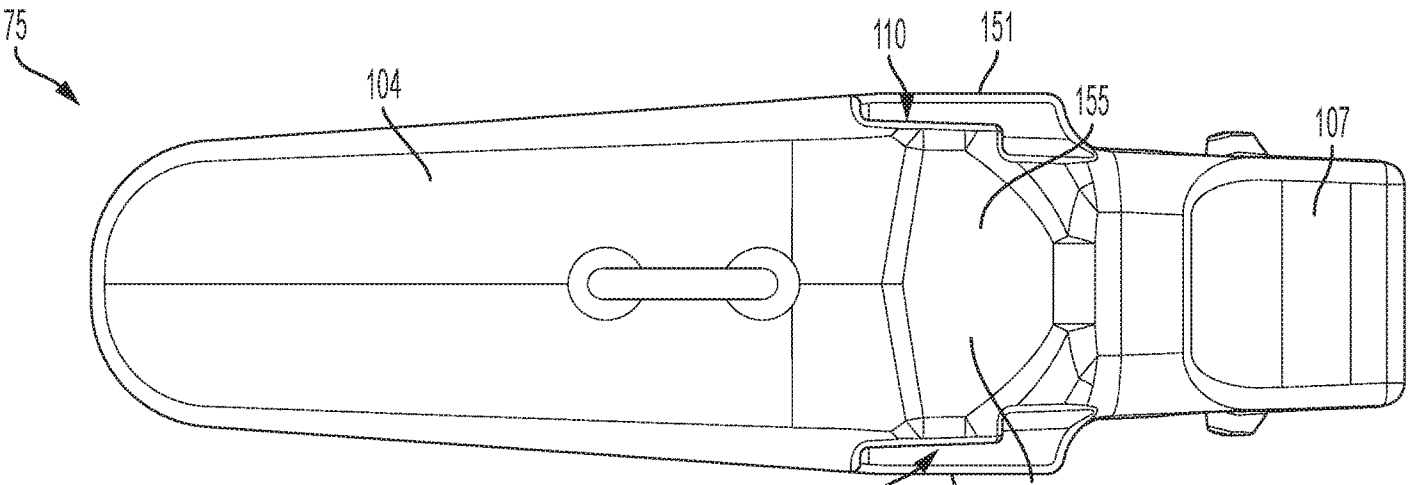
FIG. 13 is a top plan view of the tip adapter of FIG. 11.

FIGS. 11-16 show an embodiment of the adapter 75 according to principles of the present disclosure. The tip adapter 75 is configured to be used to attach the ground engaging tip 90 to the implement 60 of the machine 50. In the illustrated embodiment, the tip adapter 75 includes the base 102, the implement mounting portion 104, and the tip mounting portion 107. The implement mounting portion 104 extends from the base in opposing relationship to the tip mounting portion 107. The tip mounting portion 107 can be adapted to engage with the ground engaging tip 90, and the implement mounting portion 104 can be adapted to engage with the implement 60 of the machine 50. Referring to FIG. 11, the mounting nose 125 of the illustrated tip mounting portion 107 is generally wedge-shaped, flaring outwardly from the distal end 137 toward the base end 135.

Referring to FIGS. 12-15, the base 102 includes a first base side 151, a second base side 152, and a crown portion 155. The crown portion 155 is disposed between the first base side 151 and second base side 152. The base 102 includes a first shoulder surface 110 and a first retention surface 115. The first shoulder surface 110 and the first retention surface 115 are disposed in offset relationship to each other such that the first mounting groove 121 is defined therebetween. The first mounting groove 121 is interposed between the first base side 151 and the crown portion 155.

The base 102 includes a second shoulder surface 111 and a second retention surface 116. The second shoulder surface 111 and the second retention surface 116 are disposed in offset relationship to each other such that the second mounting groove 122 is defined therebetween. The second mounting groove 122 is interposed between the second base side 152 and the crown portion 155. The first mounting groove 121 and the second mounting groove 122 are in flanking relationship with the crown portion.

Figure 14:
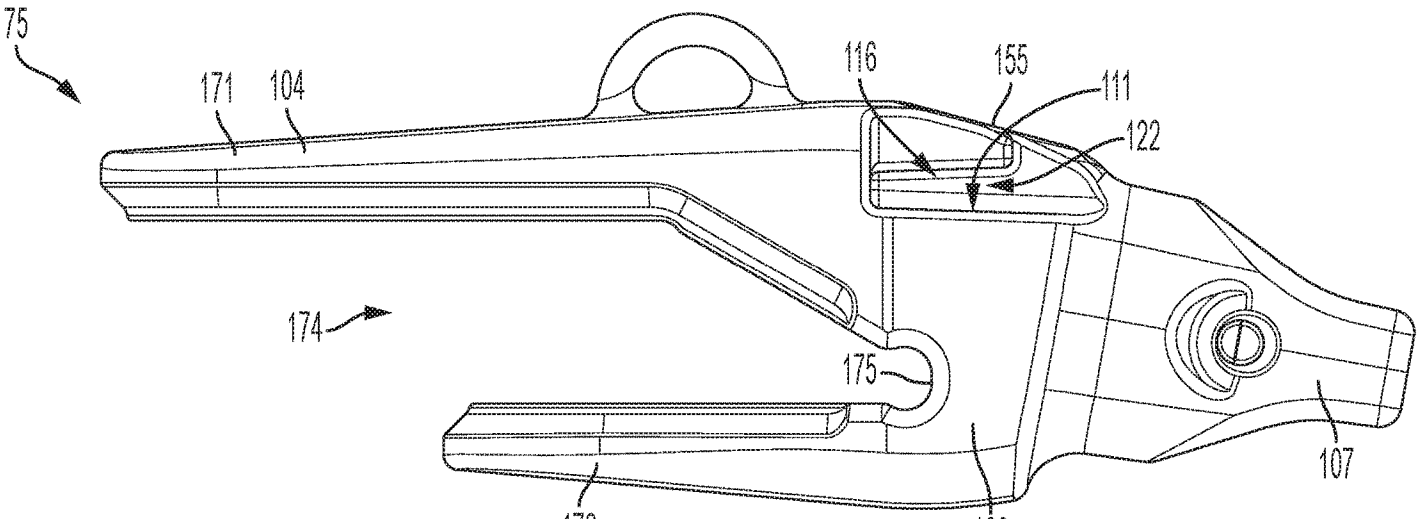
FIG. 14 is a side elevational view of the tip adapter of FIG. 11.

Referring to FIG. 14, the implement mounting portion 104 extends from the base 102 and is configured to be mounted to the implement 60 of the machine 50. In the illustrated embodiment, the implement mounting portion 104 incudes a first leg 171 and a second leg 172 extending from the base 102. The first and second legs 171, 172 define a mounting slot 174 therebetween that includes a closed end 175 at the base 102 and an opening at the proximal ends of the legs 171, 172.

The mounting slot 174 defines a direction of assembly onto the implement 60 of the machine 50. The legs 171, 172 of the implement mounting portion 104 can be moved along the direction of assembly such that the cutting edge 65 of the implement 60 is disposed within the mounting slot 174 of the adapter 75. The first and second legs 171, 172 can be attached to the implement 60 using any suitable technique, such as by being welded thereto. The parts that can make up the implement mounting portion 104 of the adapter 75 can have various different shapes and dimensions in its various possible embodiments. In other embodiments, the implement mounting portion 104 can have a different configuration as will be appreciated by one skilled in the art.

Figure 15:
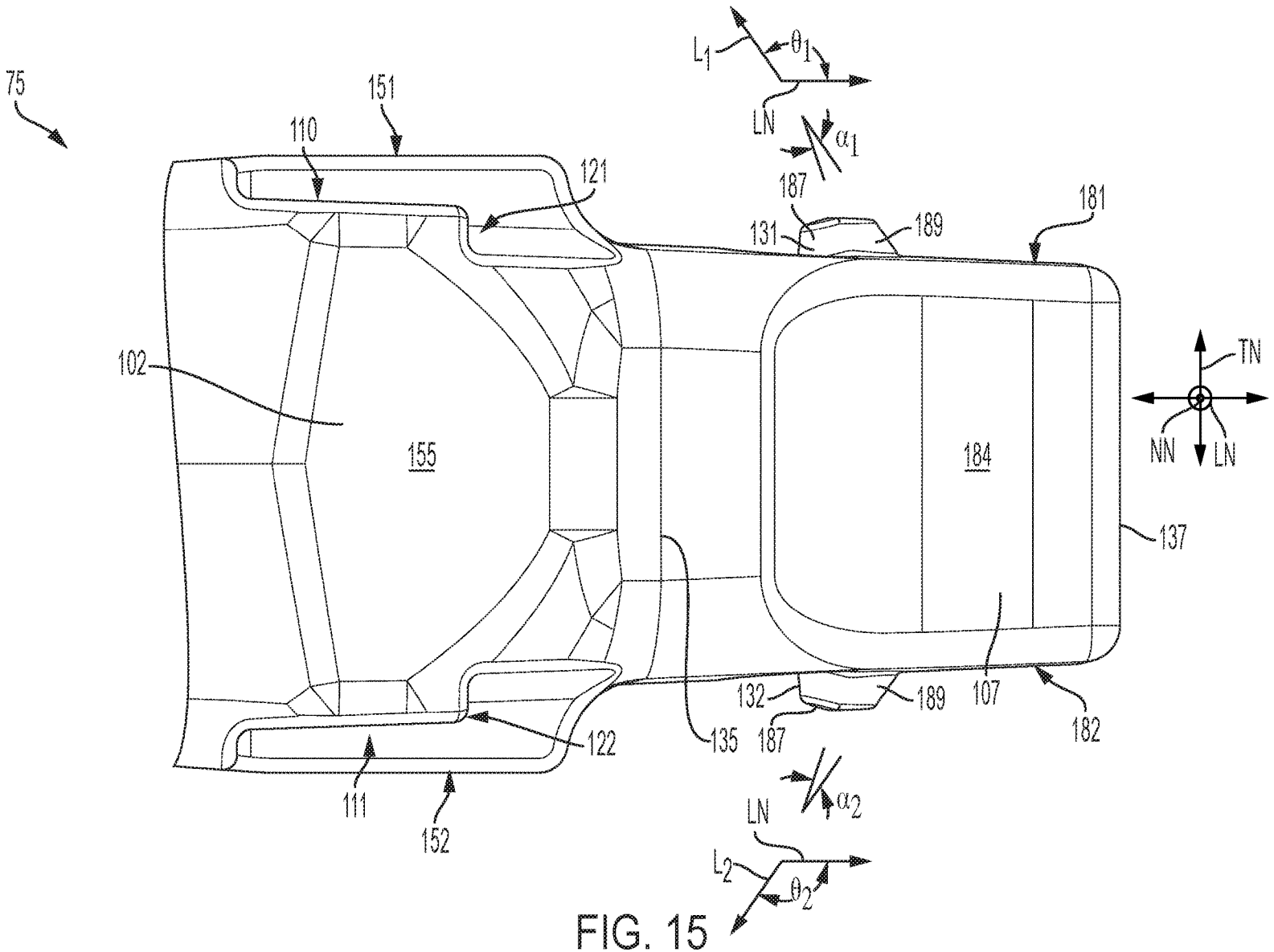
FIG. 15 is an enlarged, fragmentary top plan view of the tip adapter of FIG. 11, illustrating a mounting nose thereof.
Figure 16:
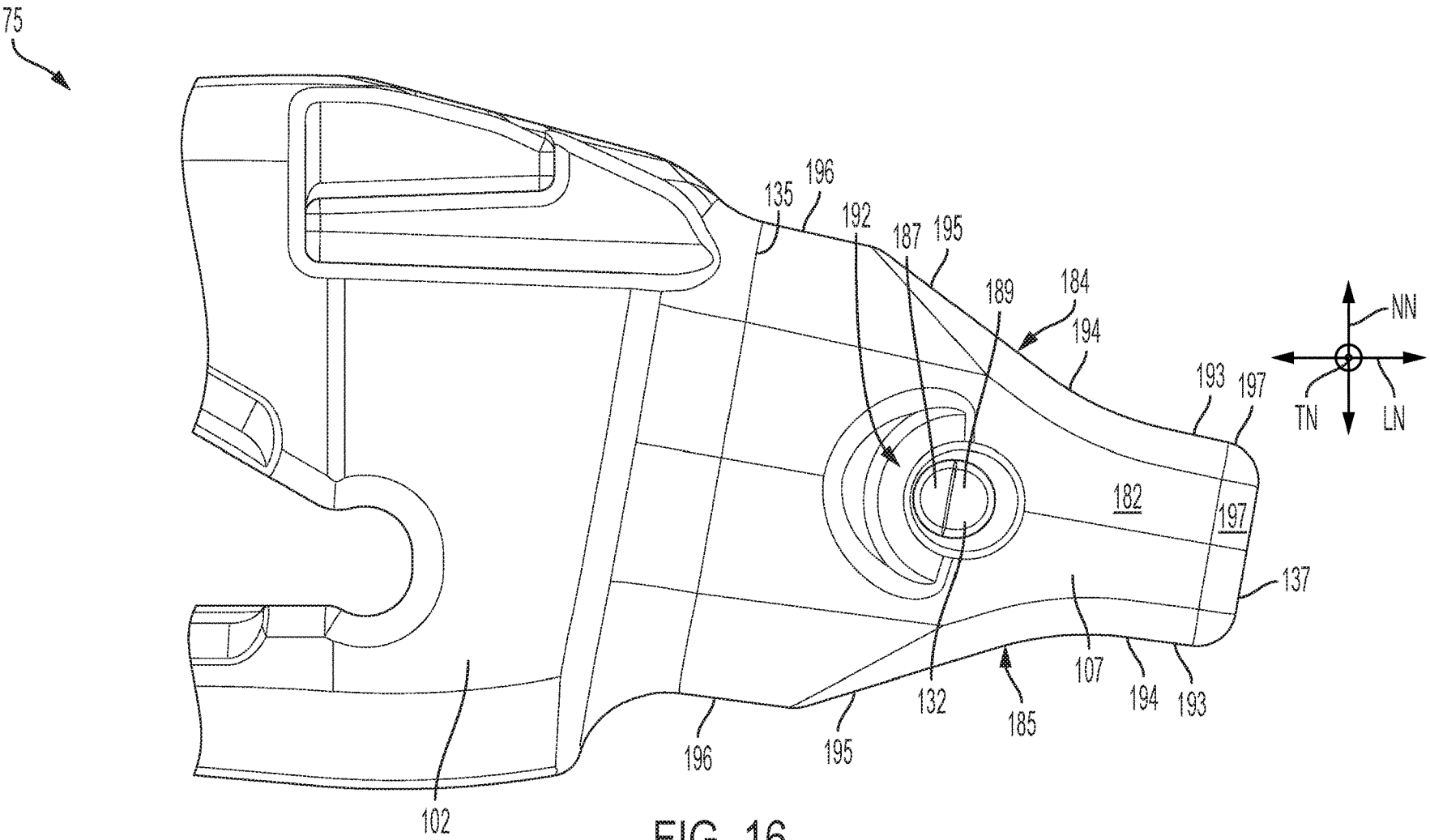
FIG. 16 is an enlarged, fragmentary side elevational view of the tip adapter of FIG. 11, illustrating the mounting nose thereof.

Referring to FIGS. 15 and 16, the tip mounting portion 107 includes the mounting nose 125, the first retention lug 131, and the second retention lug 132. The base end 135 of the mounting nose 125 is connected to the base 102.

The mounting nose 125 extends from the base end 135 to the distal end 137 along a longitudinal nose axis LN. The mounting nose 125 includes a first nose side surface 181 and a second nose side surface 182 and a first face surface 184 and a second face surface 185. The first nose side surface 181 and the second nose side surface 182 are in spaced relationship to each other along a transverse nose axis TN. The transverse nose axis TN is perpendicular to the longitudinal nose axis LN.

Referring to FIGS. 10 and 15, in the illustrated embodiment, the first and second retention lugs 131, 132 are configured such that they can extend into the first and second lug openings 321, 322, respectively. The first and second retention lugs 131, 132 are configured to fit within the first and second retention mechanisms 95, 96 for selective engagement therebetween to pivotally secure the ground engaging tip 90 and the adapter 75.

The first retention lug 131 extends from the first nose side surface 181 along a first lug axis $L_1$, and the second retention lug 132 extends from the second nose side surface 182 along a second lug axis $L_2$. The first lug axis $L_1$ and the longitudinal nose axis LN define a first lug taper angle $\theta_1$, and the second lug axis $L_2$ and the longitudinal nose axis LN define a second lug taper angle $\theta_2$. The first lug taper angle $\theta_1$ and the second lug taper angle $\theta_2$ are both oblique.

In the illustrated embodiment, the first lug axis $L_1$ and the second lug axis L2 both taper back away from the distal end 137 of the mounting nose 125. In embodiments, the first lug taper angle $\theta_1$ and the second lug taper angle $\theta_2$ are both greater than ninety degrees. In embodiment, the first lug taper angle $\theta_1$ and the second lug taper angle $\theta_2$ are about the same (±2.5°). In embodiments, the first lug taper angle $\theta_1$ and the second lug taper angle $\theta_2$ are each in a taper angle range between ninety-five and one hundred fifteen degrees. In other embodiments, the first lug taper angle $\theta_1$ and the second lug taper angle $\theta_2$ are each in a taper angle range between one hundred and one hundred ten degrees. In embodiments, the first and second lug taper angles $\theta_1$, $\theta_2$ are each about one hundred five degrees (±2.5°).

Referring to FIGS. 15 and 16, the first retention lug 131 and the second retention lug 132 each includes a cylindrical segment 187 and a frustoconical segment 189. The cylindrical segment 187 is closer to the base end 135 than the frustoconical segment 189 is, and the frustoconical segment 189 is closer to the distal end 137 than the cylindrical segment 187 is. Referring to FIG. 15, in embodiments, the frustoconical segment 189 of the first retention lug 131 and the second retention lug 132 each has a semi-vertical angle $\gamma_1$, $\gamma_2$ in a vertical angle range between ten and thirty degrees. In other embodiments, the frustoconical segment of the first retention lug 131 and the second retention lug 132 each has a semi-vertical angle $\gamma_1$, $\gamma_2$ in a vertical angle range between fifteen and twenty-five degrees.

Referring to FIGS. 10 and 16, each of the first and second nose side surfaces 181, 182 defines a retainer recess 191, 192, respectively. The retainer recess 191, 192 is adjacent the cylindrical segment 187 of the first and second retention lugs 131, 132, respectively. The retainer recesses 191, 192 are each configured to receive therein at least a portion of the first and second lug retainers 401, 402, respectively, when in the locked position (see the second lug retainer 402 in FIG. 10) to provide an interfering relationship therebetween that limits the relative movement of the adapter 75 and the ground engaging tip 90 along the longitudinal nose axis LN. In this way, the lug retainers 401, 402 can be used to selectively couple the ground engaging tip 90 to the adapter 75.

Referring to FIG. 16, the first face surface 184 and the second face surface 185 converge toward each other in a direction from the base end 135 toward the distal end 137 along a normal nose axis NN. The normal nose axis NN is perpendicular to the longitudinal nose axis LN. The transverse nose axis TN is perpendicular to the longitudinal nose axis LN and to the normal nose axis NN. The first nose side surface 181 (see, e.g., FIG.) and the second nose side surface 182 each extends between the first face surface 184 and the second face surface 185.

As shown in FIG. 16, the second face surface 185 can be in opposing relationship to the first face surface 184. The first and second face surfaces 184, 185 can be substantially symmetrical to one another about the plane defined by the longitudinal nose axis LN and the transverse nose axis TN. The first and second face surfaces 184, 185 can each define a contour profile as viewed along the transverse axis TN, such as in FIG. 16. The first face surface 184 can define a first face contour profile, and the second face surface 185 can define a second face contour profile. The first and second face contour profiles of the first and second face surfaces 184, 185 can have specific dimensions, though it is contemplated that any other suitable dimensions can be used.

Referring to FIG. 16, the contour profiles of the first and second face surfaces 184, 185 can each include a first planar nose portion 193, a concave nose portion 194, a tapered nose portion 195, and a second planar nose portion 196. The first planar nose portions 193 are adjacent the distal end 137. Each concave nose portions 194 is adjacent the respective first planar nose portion 193 and interposed between the first planar nose portion 193 and the tapered nose portion 195. Each tapered nose portion 195 is interposed between the respective concave nose portion 194 and the second planar nose portion 196. The second planar nose portion 196 are adjacent the base end 135.

The distal end 137 can extend between the first face surface 184 and the second face surface 185. The distal end 137 can provide a wall substantially perpendicular to both the first planar nose portions 193 of the first and second face surfaces 184, 185. In some embodiments, curved edges 197 can surround the distal end 137 and can form smooth transitions between the distal end 137, the first and second face surfaces 184, 185, and the first and second nose side surfaces 181, 182 (see also, FIG. 12).

FIGS. 17-22 show an embodiment of a wear cap 80 constructed according to principles of the present disclosure. The wear cap 80 is configured to be mounted to the adapter 75 such that the wear cap 80 is in overlaying relationship with the crown portion 155 of the adapter 75 (see, e.g., FIGS. 3, 4, and 8). The wear cap 80 can help protect the adapter from being worn during use of the implement 60. In embodiments, the wear cap 80 can be made from a material that is different from the material from which at least one of the adapter 75 and the ground engaging tip 90 is made). In embodiments, the wear cap 80 can be made from a material that is harder than the material from which the adapter 75 is made. In embodiments, the wear cap 80 can be made from the same material as the ground engaging tip 90.

Figure 18:
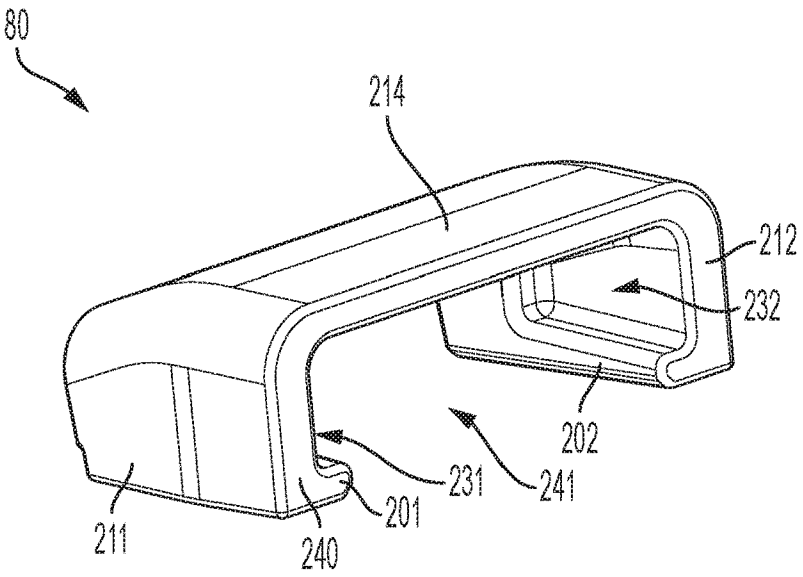
FIG. 18 is a perspective view, from a proximal cap end, of the wear cap of FIG. 17.
Figure 17:
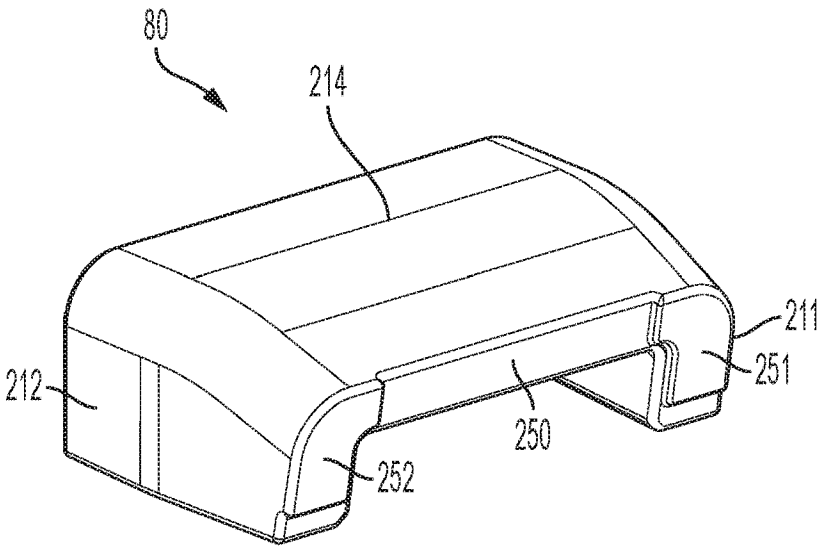
FIG. 17 is a perspective view, from a distal cap end, of a wear cap of the GET assembly of FIG. 2.

Referring to FIGS. 17 and 18, the wear cap 80 includes first cap side 211, a second cap side 212, and a top 214. The top 214 extends laterally between the first and second cap sides 211, 212. The first and second cap sides 211, 212 depend from the edges of the top 214.

Referring to FIGS. 18, 19, 21, and 22, the first and second mounting rails 201, 202 are disposed on the interior of the first and second cap sides 211, 212, respectively. The first mounting rail 201 is configured to be disposed within the first mounting groove 120 of the adapter 75 such that the first mounting rail 201 is interposed between the first retention surface 115 and the first shoulder surface 110 of the adapter 75. The second mounting rail 202 is configured to be disposed within the second mounting groove 121 of the adapter 75 such that the second mounting rail 202 is interposed between the second retention surface 116 and the second shoulder surface 111 of the adapter 75.

Figure 20:
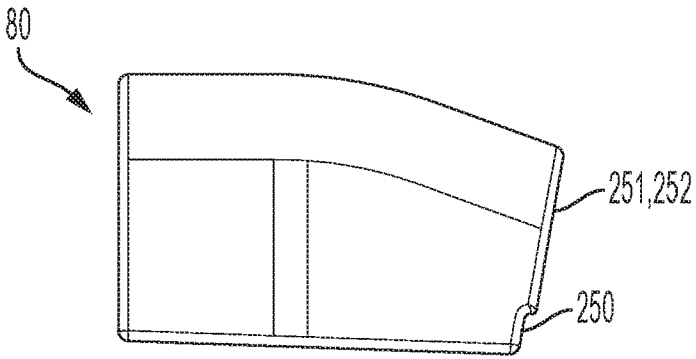
FIG. 20 is a side elevational view of the wear cap of FIG. 17.
Figure 22:
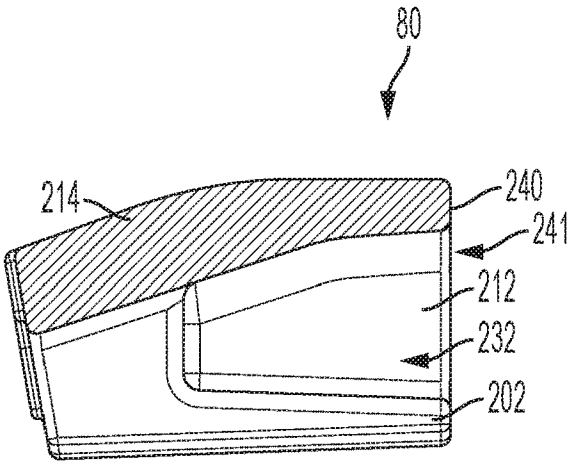
FIG. 22 is a cross-sectional view, taken along line XXII-XXII in FIG. 19, of the wear cap of FIG. 17.
Figure 19:
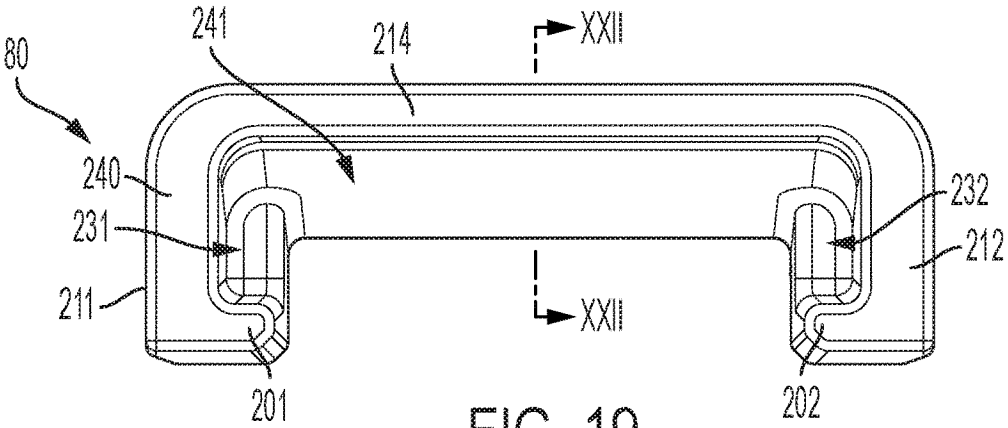
FIG. 19 is a proximal end elevational view of the wear cap of FIG. 17.
Figure 21:
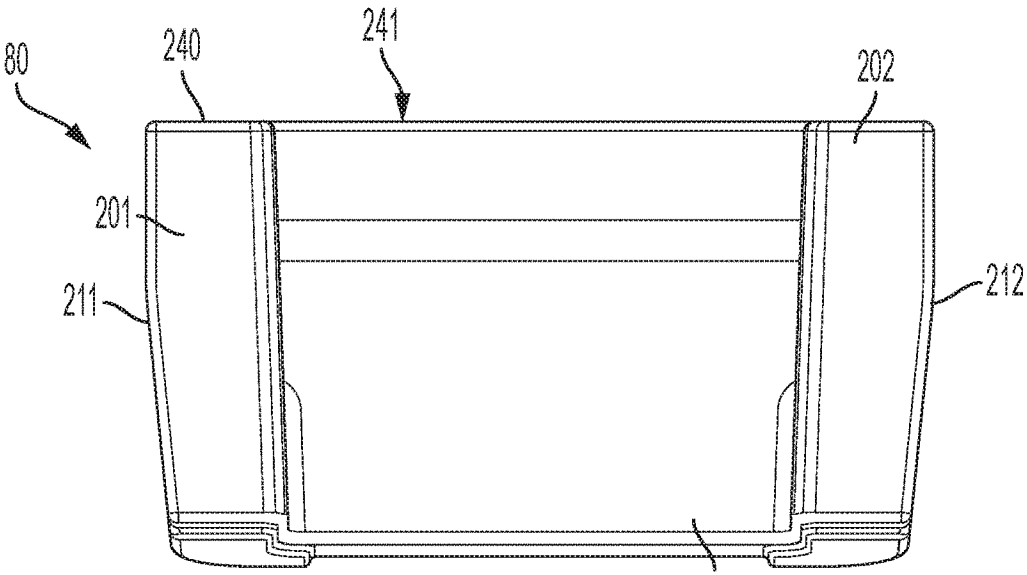
FIG. 21 is a bottom plan view of the wear cap of FIG. 17.
Figure 23:
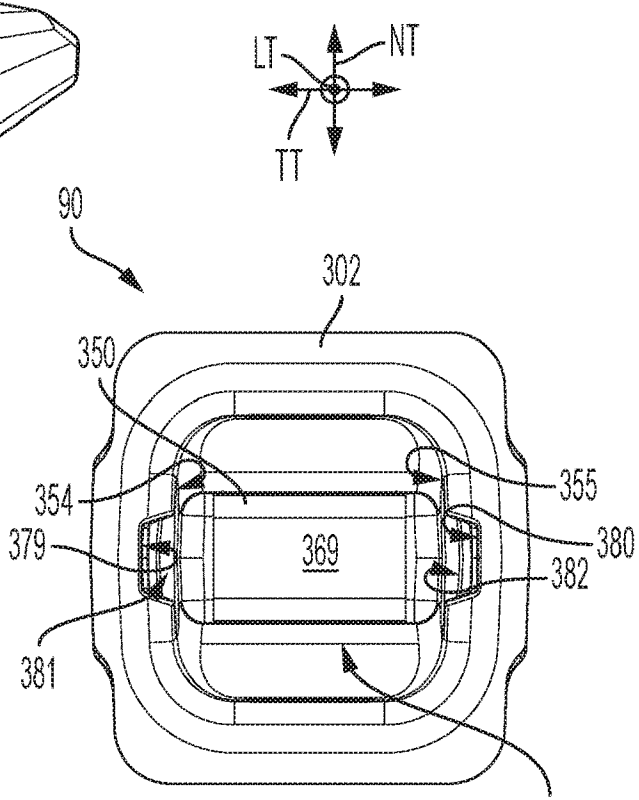
FIG. 23 is a perspective view, from a proximal tip end, of a ground engaging tip of the GET assembly of FIG. 2.

Referring to FIGS. 18, 19, and 20, the interiors of the first and second cap sides 211, 212 define a first and second adapter groove 231, 232, respectively. The first and second adapter grooves 231, 232 comprise stopped grooves that are configured to receive respectively therein the first and second retention surfaces 115, 116 of the adapter 75 when the wear cap 80 is mounted to the adapter 75.

The wear cap 80 includes a proximal cap end 240 which defines an adapter opening 241 configured to receive the crown portion 155 of the adapter therethrough when the wear cap 80 is being mounted to the adapter 75. The interior surface of the top 214 of the wear cap 80 is configured to accommodate the crown portion 155 of the adapter 75 underneath it when the wear cap 80 is fully seated on the adapter 75.

Referring to FIGS. 17 and 20, the wear cap 80 includes a distal cap end 250 having a first pad 251 and a second pad 252 projecting therefrom. In embodiments, the first pad 251 and the second pad 252 are configured to contactingly engage the ground engaging tip 90 when the ground engaging tip 90 is secured to the adapter 75 via the retention mechanism 95, 96 (see also, FIG. 8). The first and second pads 251, 252 can comprise fit pads that are configured to help engage the ground engaging tip 90 to the adapter 75 for additional structural support. The first and second pads 251, 252 act as fit pads to help provide a secure fit between the ground engaging tip 90 and the adapter 75. FIGS. 23-28 show an embodiment of the ground engaging tip 90 constructed according to principles of the present disclosure. The illustrated embodiment of the ground engaging tip 90 includes the coupling portion 302 and the ground engaging portion 304.

Figure 25:
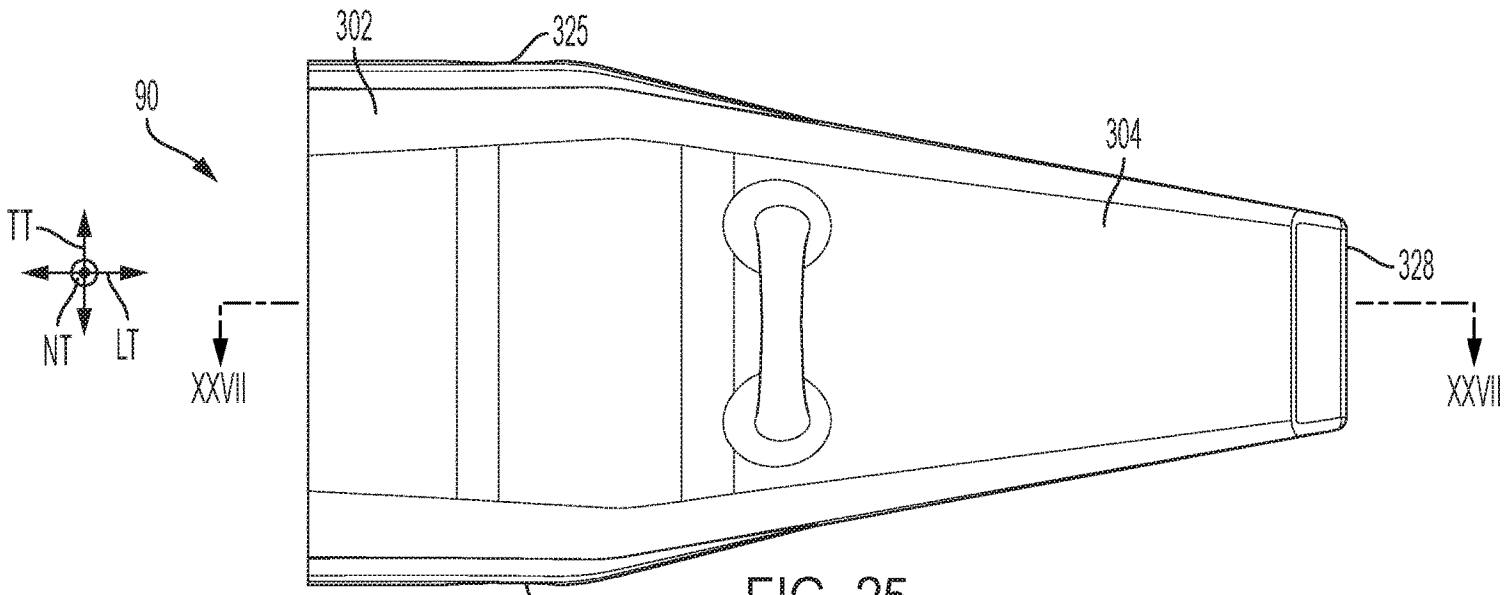
FIG. 25 is a top plan view of the ground engaging tip of FIG. 23.
Figure 26:
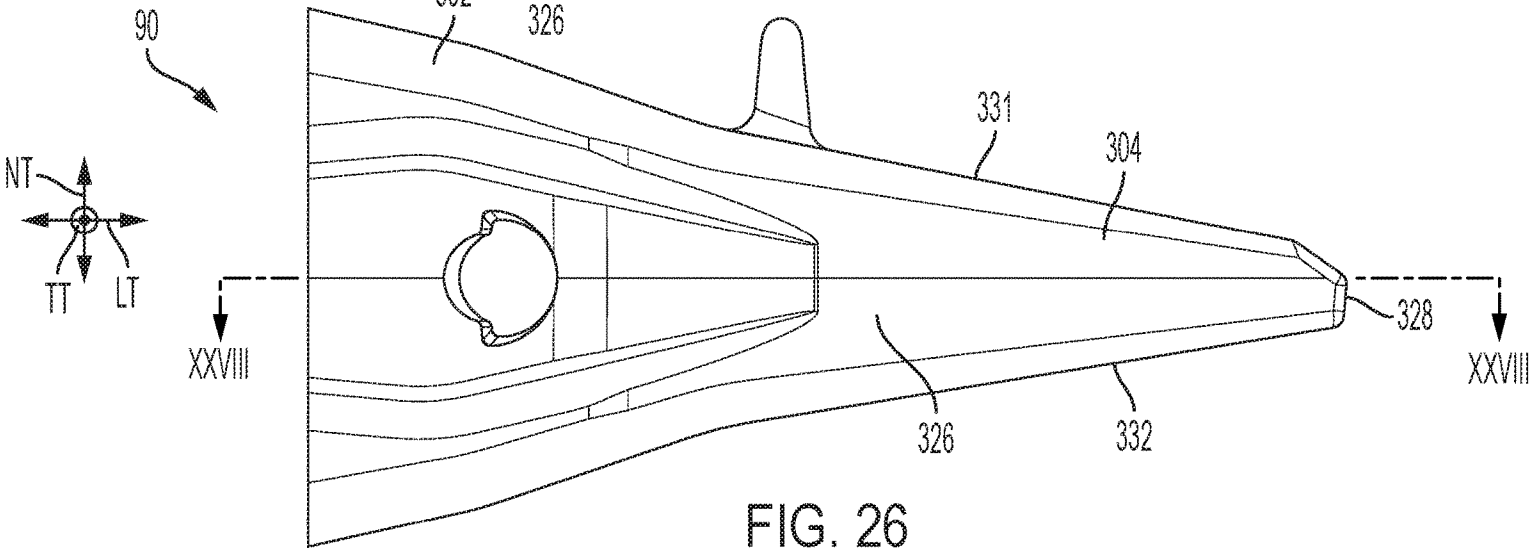
FIG. 26 is a side elevational view of the ground engaging tip of FIG. 23.

Referring to FIGS. 25 and 26, the coupling portion 302 can be in opposing relationship to the ground engaging portion 304 along a longitudinal tip axis LT thereof. The coupling portion 302 and the ground engaging portion 304 extend along a longitudinal tip axis LT. First and second tip side walls 325, 326 can extend along the longitudinal tip axis LT from the coupling portion 302 to the ground engaging portion 304. The first and second tip side walls 325, 326 are in spaced relationship to each other along a transverse tip axis TT, which is perpendicular to the longitudinal tip axis LT.

The illustrated ground engaging tip 90 can be generally wedge-shaped. A distal tip end 328 of the ground engaging portion 304 can taper to a point such that first and second tip faces 331, 332 flare outwardly moving along the longitudinal tip axis LT from the distal tip end 328 of the ground engaging portion 304 toward the coupling portion 302. The first and second tip faces 331, 332 flaring outwardly along both the transverse tip axis TT and a normal tip axis NT, which is perpendicular to both the longitudinal tip axis LT and the transverse tip axis TT (see also, FIG. 23).

Generally, the ground engaging portion 304 can be the part of the GET assembly 70 that first contacts the ground or other work material when the implement 60 is used and can be subjected to the greatest wear. Over the course of time and repeated use, the ground engaging portion 304 can wear away. When the ground engaging portion 304 has been worn away to a certain degree, the ground engaging tip 90 can be replaced.

Figure 27:
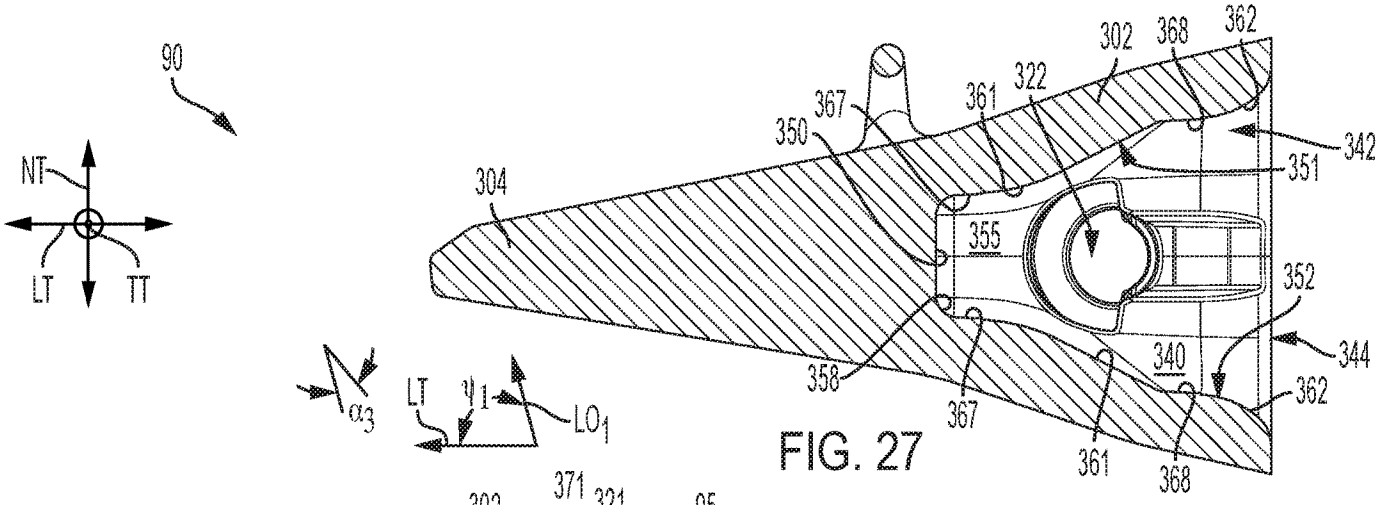
FIG. 27 is a cross-sectional view, taken along line XXVII-XXVII in FIG. 25, of the ground engaging tip of FIG. 23.
Figure 28:
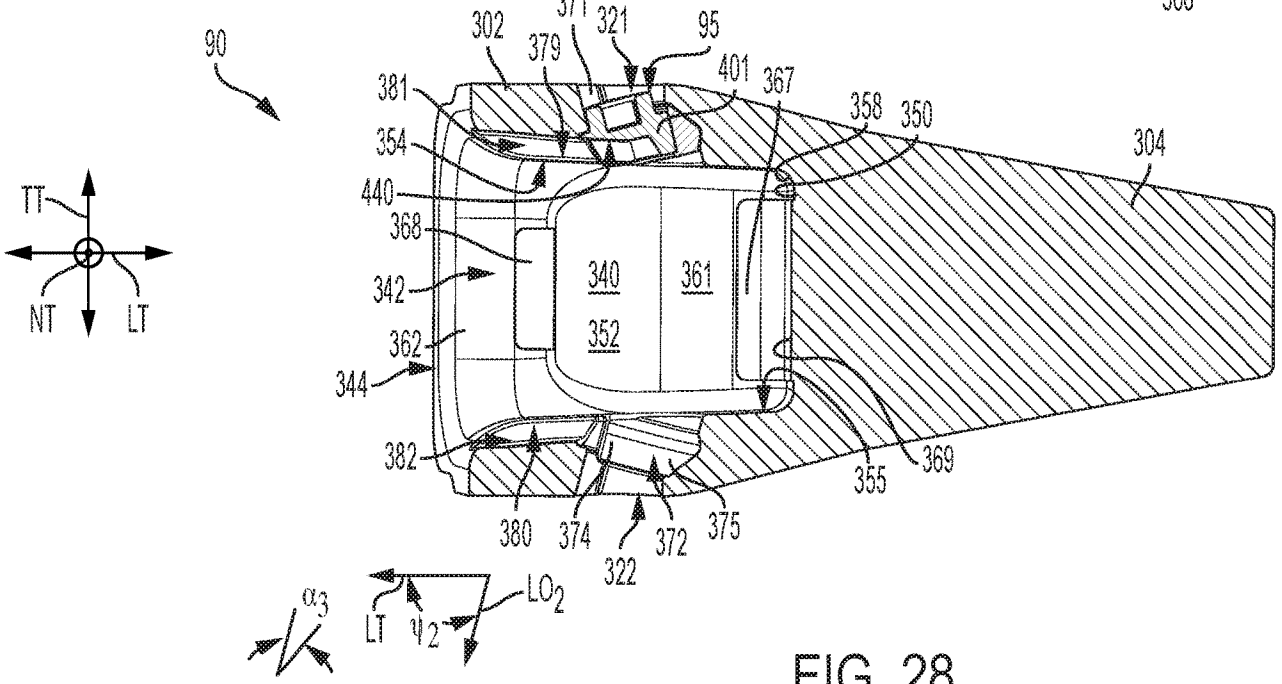
FIG. 28 is a cross-sectional view, taken along line XXVIII-XVIII in FIG. 26, of the ground engaging tip of FIG. 23.

Referring to FIGS. 27 and 28, the coupling portion 302 includes an interior surface 340 defining a coupler pocket 342 recessed within the interior of the coupling portion 302. The interior surface 340 defines the coupler pocket 342 such that it includes an adapter opening 344 disposed at the coupling portion 302, the first lug opening 321, and the second lug opening 322. The interior surface 340 defines the coupler pocket 342 such that the adapter opening 344 to the coupler pocket 342 faces in a direction substantially away from the ground engaging portion 304.

The interior surface 340 includes an interior base wall 350. The coupler pocket 342 extends from the interior base wall 350 to the adapter opening 344 along the longitudinal tip axis LT.

The interior surface 340 includes a first interior face surface 351 and a second interior face surface 352. The first interior face surface 351 can be in spaced relationship with the second interior face surface 352 along the normal tip axis NT. The first interior face surface 351 and the second interior face surface 352 converge toward each other in a direction from the adapter opening 344 toward the interior base wall 350 along the normal tip axis NT. The first and second interior face surfaces 351, 352 can be substantial mirror images of each other with respect to a plane defined by the longitudinal tip axis LT and the transverse tip axis TT.

The first interior face surface 351 and the second interior face surface 352 extend from the interior base wall 350 to the adapter opening 344 of the coupler pocket 342. The first and second interior face surfaces 351, 352 can flare away from each other in opposite directions along the normal tip axis NT moving along the longitudinal tip axis LT from the interior base wall 350 of the coupler pocket 342 to the adapter opening 344.

The interior surface 340 includes a first interior side surface 354 and a second interior side surface 355. The first interior side surface 354 and the second interior side surface 355 are in spaced relationship to each other along the transverse tip axis TT. The first interior side surface 354 and the second interior side surface 355 each extends between the first interior face surface 351 and the second interior face surface 352.

The interior base wall 350 can be generally planar and generally parallel to the adapter opening 344 of the coupler pocket 342. The first and second interior face surfaces 351, 352 and the first and second interior side surfaces 354, 355 can be all adjacent to and abut the interior base wall 350. The first and second interior face surfaces 351, 352 can extend between the first and second interior side surfaces 354, 355 from the interior base wall 350 away from the ground engaging portion 304 along the longitudinal tip axis LT toward the adapter opening 344. The interior surface 340 can transition from the interior base wall 350 to the first and second interior face surfaces 351, 352 and to the first and second interior side surfaces 354, 355 with a fillet 358. The fillet 358 can have a shape and configuration adapted to help distribute and smooth out stresses in the walls of the ground engaging tip 90 by reducing stress concentrations. In embodiments, the radius of the fillet 358 can vary throughout the coupler pocket 342.

Referring to FIG. 27, the first interior face surface 351 and the second interior face surface 352 each has a first convex portion 361 with a first convex profile and a second convex portion 362 with a second convex profile. The first convex portion 361 is adjacent the interior base wall 350, and the second convex portion 362 is adjacent the adapter opening 344 of the coupler pocket 342. In the illustrated embodiment, the first convex profile is different from the second convex profile. In embodiments, the first and second convex portions 361, 362 can have different configuration.

Referring to FIGS. 27 and 28, the first interior face surface and the second interior face surface each has a first adapter pad 367 and a second adapter pad 368. Each first adapter pad 367 and each second adapter pad 368 are generally planar. Each first adapter pad 367 is disposed between the interior base wall 350 and the first convex portion 361 of the first interior face surface 351 and the second interior face surface 352, respectively. Each first adapter pad 367 is disposed between the interior base wall 350 and the first lug opening 321 and the second lug opening 322 along the longitudinal tip axis LT. Each second adapter pad 368 is disposed between the first convex portion 361 and the second convex portion 362 of the first interior face surface 351 and the second interior face surface 352, respectively.

Figure 24:
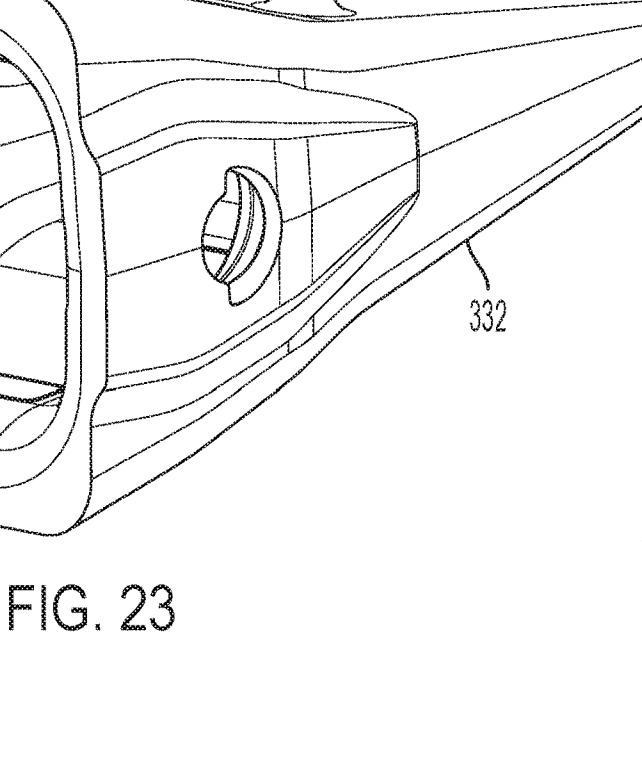
FIG. 24 is a proximal end elevational view of the ground engaging tip of FIG. 23.

The first and second adapter pads 367, 368 comprise fit pads that can provide additional structural support to the ground engaging tip 90 and can help provide a secure fit between the ground engaging tip 90 and the adapter 75. As shown in FIGS. 24 and 28, the interior base wall 350 can also include an adapter end pad 369 that comprises a fit pad.

Referring to FIG. 28, the first interior side surface 354 and the second interior side surface 355 respectively define the first lug opening 321 and the second lug opening 322. The first lug opening 321 extends along a first lug opening axis $LO_1$, and the second lug opening extends along a second lug opening axis $LO_2$. The first lug opening axis $LO_1$ and the longitudinal tip axis LT define a first lug opening taper angle $\psi_1$, and the second lug opening axis $LO_2$ and the longitudinal tip axis LT define a second lug opening taper angle $\psi_2$. The first lug opening taper angle $\psi_1$ and the second lug opening taper angle $\psi_2$ are both oblique. In embodiments, the first lug opening taper angle $\psi_1$ and the second lug opening taper angle $\psi_2$ are substantially complementary to the first lug taper angle $\theta_1$ and the lug taper angle $\theta_2$, respectively.

In embodiments, the first lug opening taper angle $\psi_1$ and the second lug opening taper angle $\psi_2$ are each in an opening taper angle range between sixty-five and eighty-five degrees. In other embodiments, the first lug opening taper angle $\psi_1$ and the second lug opening taper angle $\psi_2$ are each in an opening taper angle range between seventy and eighty degrees.

Referring to FIG. 28, the first interior side surface 354 and the second interior side surface 355 each includes a lug passage surface 371, 372 defining the first lug opening 321 and the second lug opening 322, respectively. The lug passage 371, 372 of the first interior side surface 354 and the second interior side surface 355 can be configured such that the first retention lug 131 and the second retention lug 132 of the adapter 75 can be respectively disposed therein.

The lug passage 371, 372 of the first interior side surface 354 and the second interior side surface 355 can also be configured such that the retention mechanisms 95, 96 can be respectively disposed therein. In FIG. 28, the first retention mechanism 95 is shown disposed in the lug passage surface 371 of the first interior side surface 354.

As such, the lug passage 371, 372 of each of the first interior side surface 354 and the second interior side surface 355 has a cylindrical segment surface 374 and a frustoconical segment surface 375. The cylindrical segment surface 374 is closer to the adapter opening 344 than the frustoconical segment surface 375 is. The frustoconical segment surface 375 is closer to the interior base wall 350 than the cylindrical segment surface 374 is. The cylindrical segment surface 374 and the frustoconical segment surface 375 are configured to accommodate one of the retention mechanisms 95, 96 therein.

In embodiments, the cylindrical segment surface 374 of the first interior side surface and the second interior side surface are aligned with the first lug opening axis $LO_1$ and the second lug opening axis $LO_2$, respectively. In embodiments, the frustoconical segment surface 375 of the first interior side surface 354 and the second interior side surface 355 each has a semi-vertical angle $\gamma_3$, $\gamma_4$ in a vertical angle range between ten and thirty degrees.

Referring to FIGS. 24 and 28, in the illustrated embodiment, the first interior side surface 354 and the second interior side surface 355 each includes a lug groove surface 379, 380 defining a first lug groove 381 and a second lug groove 382, respectively. The first lug groove 381 extends along the longitudinal tip axis LT between the adapter opening 344 and the first lug opening 321, and the second lug groove 382 extends along the longitudinal tip axis LT between the adapter opening 344 and the second lug opening 322. The first lug groove 381 and the second lug groove 382 are configured to receive the first retention lug 131 and the second retention lug 132 therein, respectively, as the mounting nose 125 of the adapter 75 is inserted into the coupler pocket 342 of the ground engaging tip 90 to seat the first and second retention lugs 131, 132 into the first and second lug openings 321, 322, respectively.

Figure 8:
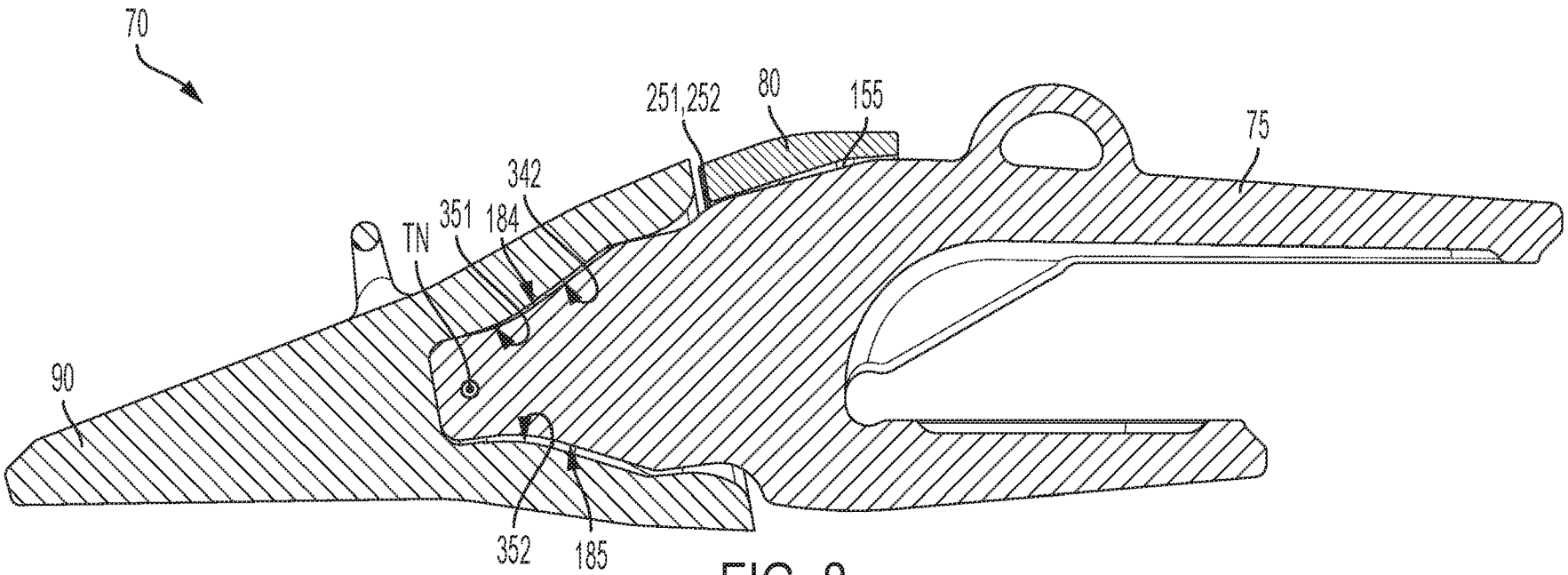
FIG. 8 is a cross-sectional view, taken along line VIII-VIII in FIG. 6, of the GET assembly of FIG. 2.

Referring to FIG. 8, the mounting nose 125 of the adapter 75 is disposed within the coupler pocket 342 of the ground engaging tip 90 such that the first face surface 184 and the second face surface 185 of the adapter 75 are respectively adjacent the first interior face surface 351 and the second interior face surface 352 of the ground engaging tip 90. The ground engaging tip 90 is pivotally connected to the adapter 75 via the retention mechanisms 95, 96 such that the ground engaging tip 90 is movable with respect to the adapter 75 over a range of travel about a retention axis substantially parallel to the transverse nose axis TN of the adapter 75. Intermediate portions of the first interior face surface 351 and the second interior face surface 352 of the ground engaging tip 90 are in respective non-contacting, spaced relationship with the first face surface 184 and the second face surface 185 of the adapter 75.

FIGS. 29-36 show an embodiment of a lug retainer 401 of a retention mechanism 95 constructed according to principles of the present disclosure. In embodiments, the retention mechanisms 95, 96 can include the lug retainer 401, 402 and the locking sleeve 411, 412. In the illustrated embodiment, the retention mechanisms 95, 96 are substantially the same. Accordingly, it will be understood that the description of the lug retainer 401 shown in FIGS. 29-36 is equally applicable to both the first lug retainer 401 and the second lug retainer 402.

Figure 30:
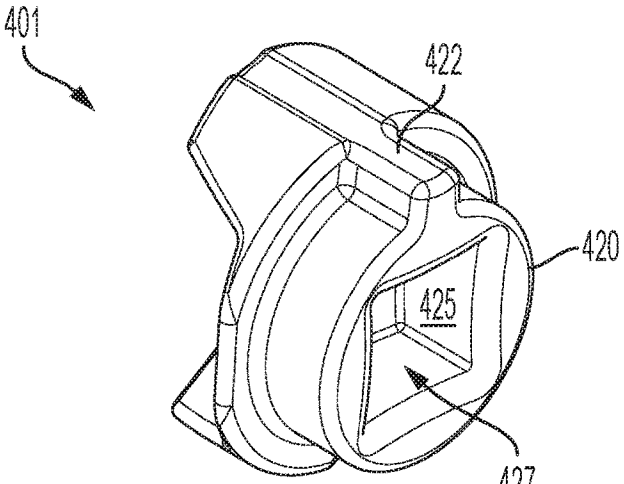
FIG. 30 is another perspective view, from the tool end, of the lug retainer of FIG. 29.
Figure 29:
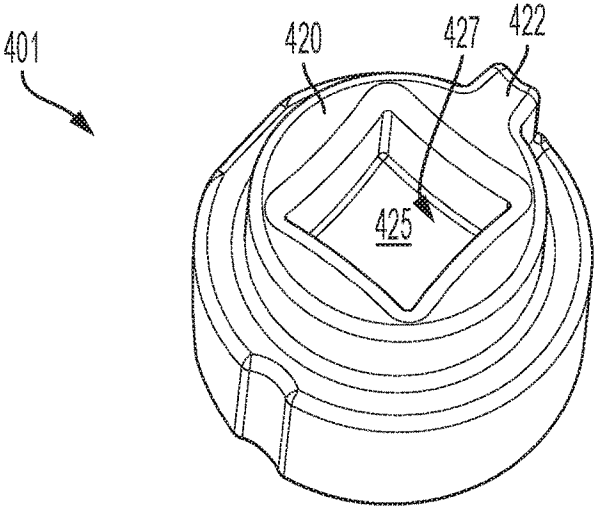
FIG. 29 is a perspective view, from a tool end, of a lug retainer of the GET assembly of FIG. 2.

Referring to FIGS. 29 and 30, the lug retainer 401 includes a head portion 420. The head portion 420 is generally cylindrical but includes a stop 422 that extends radially outwardly therefrom. The stop 422 is configured to help limit the rotational relative movement of the lug retainer with respect to the C-shaped locking sleeve 411 with which it is associated between the locked position (the second lug retainer 402 is in the locked position in FIG. 10) and the unlocked position (the first lug retainer 401 is in the unlocked position in FIG. 10). The head portion 420 include a tool interface surface 425 which defines a tool cavity configured to receive a tool therein to facilitate the relative rotational movement of the lug retainer 401 and the locking sleeve 411. In the illustrated embodiment, the tool cavity 427 if generally rectangular-shaped (see also, FIG. 36). In other embodiments, the tool interface surface 425 can be configured differently to define a different-shaped tool cavity 427 (e.g., a cross-shaped cavity).

Figure 32:
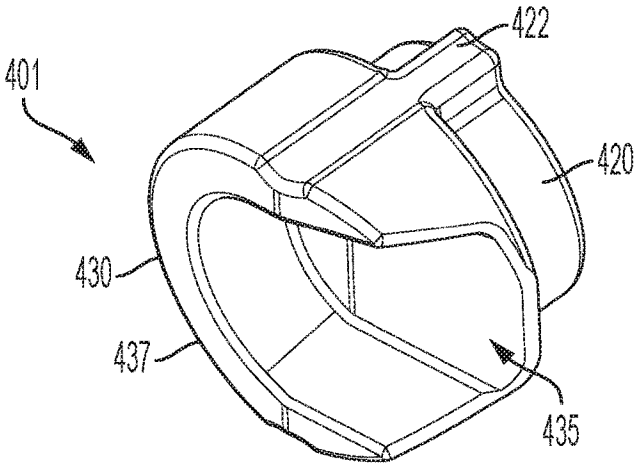
FIG. 32 is another perspective view, from the lock end, of the lug retainer of FIG. 29.
Figure 31:
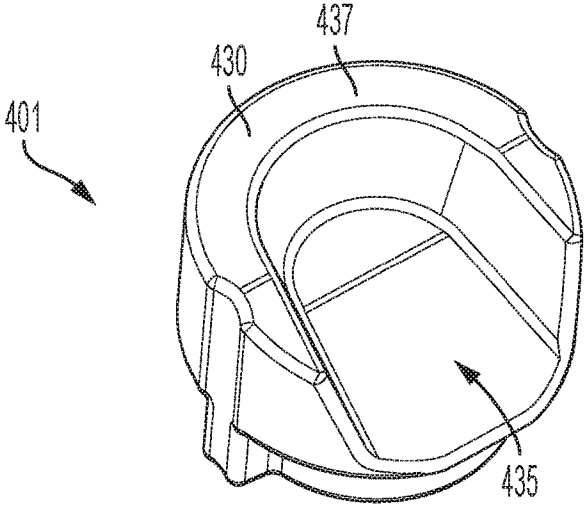
FIG. 31 is a perspective view, from a lock end, of the lug retainer of FIG. 29.
Figure 34:
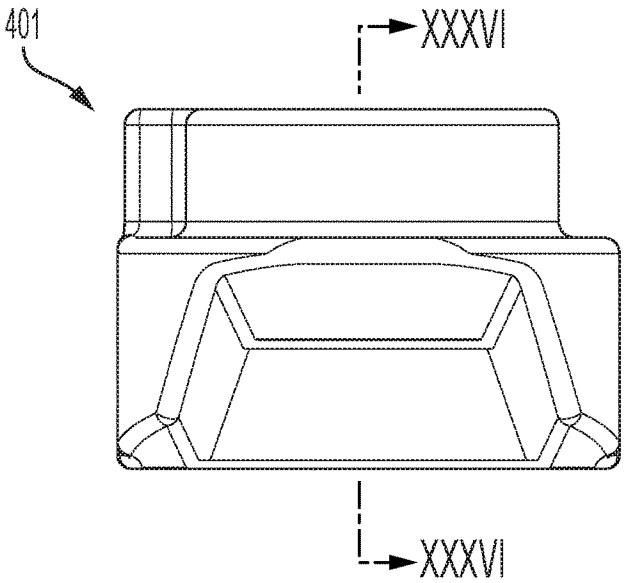
FIG. 34 is a first side elevational view of the lug retainer of FIG. 29.
Figure 33:
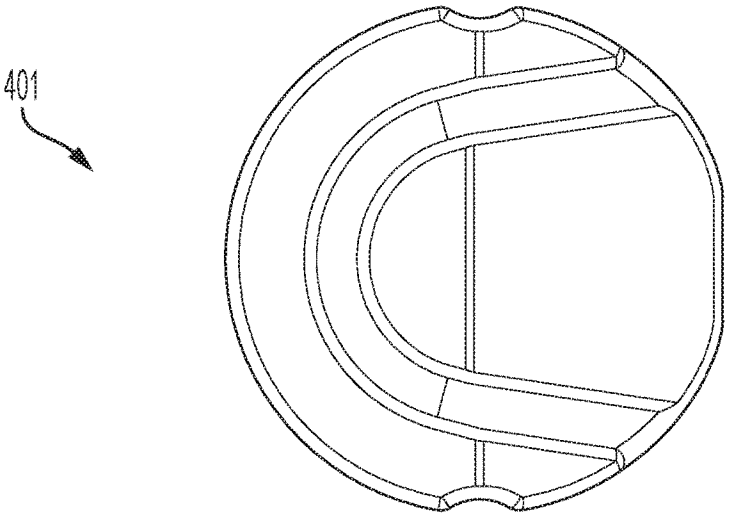
FIG. 33 is a lock end plan view of the lug retainer of FIG. 29.
Figure 36:
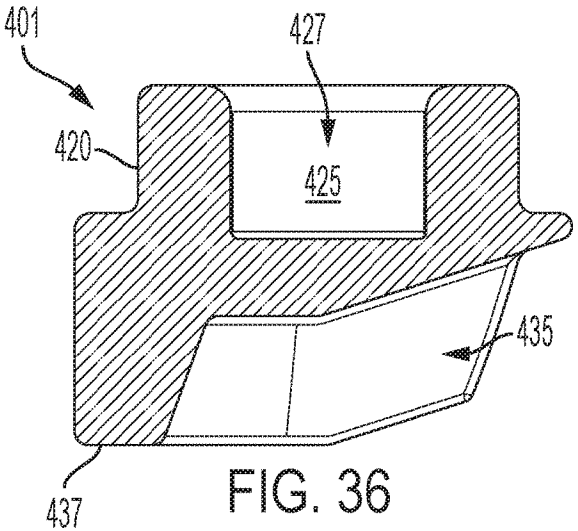
FIG. 36 is a cross-sectional view, taken along line XXXVI-XXXVI in FIG. 34, of the lug retainer of FIG. 29.
Figure 35:
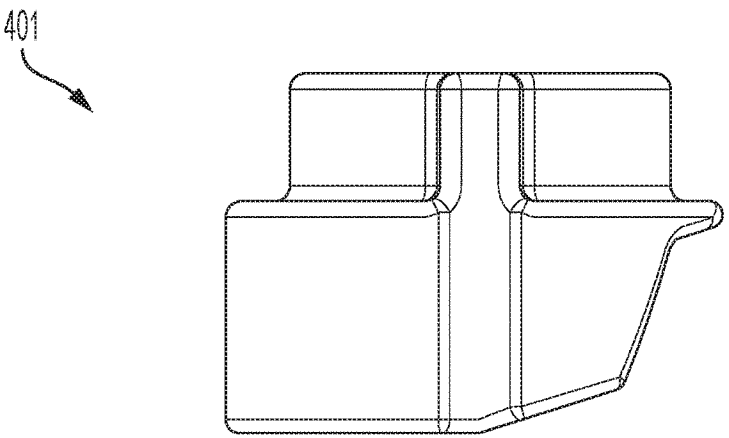
FIG. 35 is a second side elevational view of the lug retainer of FIG. 29.

Referring to FIGS. 31 and 32, the lug retainer 401 includes a locking portion 430 defining a slot 435 therein. The slot 435 can be defined in a lug locking wall 437 of the locking portion 430. The lug locking wall 437 is generally C-shaped.

The locking portion 430 of the lug retainer 401 includes a tapered slot base surface 440. The tapered slot base surface 440 is configured to be substantially aligned with the lug groove surface 381 of the ground engaging tip 90 when the lug retainer 401 is in the unlocked position (see, e.g., FIG. 28).

Referring to FIG. 10, the first lug retainer 401 and the second lug retainer 402 are rotatably disposed in the first and second lug openings 321, 322 of the ground engaging tip 90, respectively, such that the first retention lug 131 is disposed within the slot 435 of the locking portion 430 of the first lug retainer 401 and the second retention lug 132 is disposed within the slot 435 of the locking portion 430 of the second lug retainer 402. The first and second lug retainers are both rotatable over a range of travel between an unlocked position, in which the first retention lug 131 and the second retention lug 132 are unimpeded by the lug locking wall 437 of the lug retainer 401, 402 from being removed from the coupler pocket 342 of the ground engaging tip 90 via relative movement along the longitudinal nose axis LN in a removal direction 442, and a locked position, in which the lug locking wall 437 of the lug retainer 401, 402 impedes the relative movement of the associated retention lug 131, 132 with respect to the ground engaging tip 90 in the removal direction 442.

The retention mechanisms 95, 96 can secure the ground engaging tip 90 to the adapter 75 and substantially limit the relative movement of these components with respect to one another such that the GET assembly 70 can be in a nominal position when the GET assembly 70 is not in use. When the components of the GET assembly 70 are subjected to forces, either along the transverse nose axis TN or the normal nose axis NN, the retention mechanisms 95, 96 can continue to secure the components to one another, but can allow the parts to rotate with respect to one another about transverse nose axis TN and/or the normal nose axis NN in response to the forces to which they can be subjected. The respective component parts of the GET assembly 70 can rotate relative to one another into a maximum rotated position in which the parts can contact one another at various points, thereby restraining further relative rotational movement.

INDUSTRIAL APPLICABILITY

The industrial application of embodiments of a GET assembly described herein should be readily appreciated from the foregoing discussion. The disclosed principles can be applicable to any machine utilizing an implement for digging, scraping, leveling, or any other suitable application involving engaging the ground or other work material. In machines used for such applications, ground engaging tools and tips can wear out quickly and require replacement. In such applications, replacement of ground engaging tools and tips can be expected, but it can be desirable to extend the life of such tools for as long as possible to limit machine downtime and replacement costs. The present disclosure has features, as discussed, which can reduce the probability of part failure and increase usable life of the ground engaging tools. Reducing part failure can increase machine uptime and save on costs of replacement parts.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A ground engaging tip for a machine implement, the ground engaging tip comprising:

a ground engaging portion;

a coupling portion, the coupling portion and the ground engaging portion extending along a longitudinal tip axis, the coupling portion including an interior surface defining a coupler pocket having an adapter opening disposed at the coupling portion, a first lug opening, and a second lug opening, wherein:

the interior surface includes an interior base wall, the coupler pocket extending from the interior base wall to the adapter opening along the longitudinal tip axis, the interior surface includes a first interior face surface and a second interior face surface, the first interior face surface and the second interior face surface converging toward each other in a direction from the adapter opening toward the interior base wall along a normal tip axis, the normal tip axis being perpendicular to the longitudinal tip axis, the interior surface includes a first interior side surface and a second interior side surface, the first interior side surface and the second interior side surface being in spaced relationship to each other along a transverse tip axis, the transverse tip axis being perpendicular to the longitudinal tip axis and to the normal tip axis, the first interior side surface and the second interior side surface each extending between the first interior face surface and the second interior face surface, the first interior side surface and the second interior side surface respectively define the first lug opening and the second lug opening, the first lug opening extending along a first lug opening axis, and the second lug opening extending along a second lug opening axis, the first lug opening axis and the longitudinal tip axis defining a first lug opening taper angle, the second lug opening axis and the longitudinal tip axis defining a second lug opening taper angle, the first lug opening taper angle and the second lug opening taper angle both being oblique, and the first interior face surface and the second interior face surface each has a first adapter pad, the first adapter pad being generally planar and disposed between the interior base wall and the first lug opening and the second lug opening along the longitudinal tip axis.

2. The ground engaging tip according to claim 1, wherein the first lug opening taper angle and the second lug opening taper angle are each in an opening taper angle range between sixty-five and eighty-five degrees.

3. The ground engaging tip according to claim 1, wherein the first lug opening taper angle and the second lug opening taper angle are each in an opening taper angle range between seventy and eighty degrees.

4. The ground engaging tip according to claim 1, wherein the first interior side surface and the second interior side surface each includes a lug groove surface defining a first lug groove and a second lug groove, respectively, the first lug groove extending along the longitudinal tip axis between the adapter opening and the first lug opening, and the second lug groove extending along the longitudinal tip axis between the adapter opening and the second lug opening.

5. The ground engaging tip according to claim 1, wherein the first interior face surface and the second interior face surface each has a first convex portion with a first convex profile and a second convex portion with a second convex profile, the first convex profile being different from the second convex profile, the first convex portion adjacent the interior base wall, and the second convex portion adjacent the adapter opening of the coupler pocket.

6. The ground engaging tip according to claim 5, wherein the first interior face surface and the second interior face surface each has a second adapter pad, each second adapter pad being generally planar, each first adapter pad being disposed between the interior base wall and the first convex portion of the first interior face surface and the second interior face surface, respectively, and each second adaptor pad being disposed between the first convex portion and the second convex portion of the first interior face surface and the second interior face surface, respectively.

7. The ground engaging tip according to claim 1, wherein the first interior side surface and the second interior side surface each includes a lug passage surface defining the first lug opening and the second lug opening, respectively, the lug passage surface of each of the first interior side surface and the second interior side surface having a cylindrical segment surface and a frustoconical segment surface, the cylindrical segment surface being closer to the adapter opening than the frustoconical segment surface is, and the frustoconical segment surface being closer to the interior base wall than the cylindrical segment surface is.

8. The ground engaging tip according to claim 7, wherein the frustoconical segment surface of the first interior side surface and the second interior side surface each has a semi-vertical angle in a vertical angle range between ten and thirty degrees.

9. The ground engaging tip according to claim 7, wherein the cylindrical segment surface of the first interior side surface and the second interior side surface are aligned with the first lug opening axis and the second lug opening axis, respectively.

10. The ground engaging tip according to claim 7, wherein the first interior side surface and the second interior side surface each includes a lug groove surface defining a first lug groove and a second lug groove, respectively, the first lug groove extending along the longitudinal tip axis between the adapter opening and the first lug opening, and the second lug groove extending along the longitudinal tip axis between the adapter opening and the second lug opening.

11. A ground engaging tool assembly comprising:

an adapter, the adapter including a base, an implement mounting portion, and a tip mounting portion, the implement mounting portion extending from the base and configured to be mounted to a machine implement, the tip mounting portion extending from the base in opposing relationship to the implement mounting portion, the tip mounting portion including a mounting nose, a first retention lug, and a second retention lug, wherein the mounting nose includes a base end and a distal end, the base end connected to the base, the mounting nose extending from the base end to the distal end along a longitudinal nose axis, the mounting nose includes a first nose side surface and a second nose side surface, the first nose side surface and the second nose side surface being in spaced relationship to each other along a transverse nose axis, the transverse nose axis being perpendicular to the longitudinal nose axis, and wherein the first retention lug extends from the first nose side surface along a first lug axis, and the second retention lug extends from the second nose side surface along a second lug axis, the first lug axis and the longitudinal nose axis defining a first lug taper angle, the second lug axis and the longitudinal nose axis defining a second lug taper angle, the first lug taper angle and the second lug taper angle both being oblique;

a ground engaging tip, the ground engaging tip having a coupling portion and a ground engaging portion, the coupling portion and the ground engaging portion extending along a longitudinal tip axis, the coupling portion including an interior surface defining a coupler pocket having an adapter opening, a first lug opening, and a second lug opening, wherein:

the interior surface includes an interior base wall, the coupler pocket extending from the interior base wall to the adapter opening along the longitudinal tip axis, the interior surface includes a first interior face surface and a second interior face surface, the first interior face surface and the second interior face surface converging toward each other in a direction from the adapter opening toward the interior base wall along a normal tip axis, the normal tip axis being perpendicular to the longitudinal tip axis, the interior surface includes a first interior side surface and a second interior side surface, the first interior side surface and the second interior side surface being in spaced relationship to each other along a transverse tip axis, the transverse tip axis being perpendicular to the longitudinal tip axis and to the normal tip axis, the first interior side surface and the second interior side surface each extending between the first interior face surface and the second interior face surface, the first interior side surface and the second interior side surface respectively defining the first lug opening and the second lug opening, and the first interior face surface and the second interior face surface each has a first adapter pad, the first adapter pad being generally planar and disposed between the interior base wall and the first lug opening and the second lug opening along the longitudinal tip axis;

wherein the mounting nose of the adapter is disposed within the coupler pocket of the ground engaging tip, the first retention lug and the second retention lug projecting from the mounting nose of the adapter and respectively extending into the first lug opening and the second lug opening of the ground engaging tip.

12. The ground engaging tool assembly according to claim 11, wherein:

the first lug opening extends along a first lug opening axis, and the second lug opening extends along a second lug opening axis, the first lug opening axis and the longitudinal tip axis defining a first lug opening taper angle, the second lug opening axis and the longitudinal tip axis defining a second lug opening taper angle, the first lug opening taper angle and the second lug opening taper angle both being oblique, and wherein the first lug opening taper angle and the second lug opening taper angle are substantially complementary to the first lug taper angle and the second lug taper angle, respectively.

13. The ground engaging tool assembly according to claim 12, wherein the first interior side surface and the second interior side surface of the ground engaging tip each includes a lug groove surface defining a first lug groove and a second lug groove, respectively, the first lug groove extending along the longitudinal tip axis between the adapter opening and the first lug opening, and the second lug groove extending along the longitudinal tip axis between the adapter opening and the second lug opening.

14. The ground engaging tool assembly according to claim 12, wherein the first interior side surface and the second interior side surface of the ground engaging tip each includes a lug passage surface defining the first lug opening and the second lug opening, respectively, the first retention lug and the second retention lug of the adapter disposed in the lug passage surface of the first interior side surface and the second interior side surface, respectively.

15. The ground engaging tool assembly according to claim 14, wherein the first interior side surface and the second interior side surface of the ground engaging tip each includes a lug groove surface defining a first lug groove and a second lug groove, respectively, the first lug groove extending along the longitudinal tip axis between the adapter opening and the first lug opening, and the second lug groove extending along the longitudinal tip axis between the adapter opening and the second lug opening.

16. The ground engaging tool assembly according to claim 14, further comprising:

a first lug retainer and a second lug retainer, the first lug retainer and the second lug retainer each including a locking portion defining a slot therein, the first lug retainer and the second lug retainer rotatably disposed in the first lug opening of the first interior side surface and the second lug opening the second interior side surface of the ground engaging tip, respectively, such that the first retention lug is disposed within the slot of the locking portion of the first lug retainer and the second retention lug is disposed within the slot of the locking portion of the second lug retainer, each of the first lug retainer and the second lug retainer rotatable over a range of travel between an unlocked position, in which the first retention lug and the second retention lug are unimpeded by the first lug retainer and the second lug retainer, respectively, from being removed from the coupler pocket of the ground engaging tip via relative movement along the longitudinal nose axis in a removal direction, and a locked position, in which the locking portion impedes the relative movement of the first retention lug and the second retention lug with respect to the ground engaging tip.

17. The ground engaging tool assembly according to claim 16, wherein the first interior side surface and the second interior side surface of the ground engaging tip each includes a lug groove surface defining a first lug groove and a second lug groove, respectively, the first lug groove extending along the longitudinal tip axis between the adapter opening and the first lug opening, and the second lug groove extending along the longitudinal tip axis between the adapter opening and the second lug opening, and wherein the locking portion of each of the first lug retainer and the second lug retainer includes a tapered slot base surface, the tapered slot base surface configured to be substantially aligned with the lug groove surface of the first interior side surface and the second interior side surface of the ground engaging tip, respectively, when in the unlocked position.

18. The ground engaging tool assembly according to claim 14, wherein the first interior face surface and the second interior face surface of the ground engaging tip each has a first convex portion with a first convex profile and a second convex portion with a second convex profile, the first convex profile being different from the second convex profile, the first convex portion adjacent the interior base wall, and the second convex portion adjacent the adapter opening of the coupler pocket, wherein the mounting nose of the adapter includes a first face surface and a second face surface, the first face surface and the second face surface converging toward each other in a direction from the base end toward the distal end along a normal nose axis, the normal nose axis being perpendicular to the longitudinal nose axis and the transverse nose axis, the first nose side surface and the second nose side surface each extending between the first face surface and the second face surface, wherein the mounting nose of the adapter is disposed within the coupler pocket of the ground engaging tip such that the first face surface and the second face surface of the adapter are respectively adjacent the first interior face surface and the second interior face surface of the ground engaging tip.

19. The ground engaging tool assembly according to claim 18, wherein the first interior face surface and the second interior face surface each has a second adapter pad, each second adapter pad being generally planar, each first adapter pad being disposed between the interior base wall and the first convex portion of the first interior face surface and the second interior face surface, respectively, and each second adaptor pad being respectively disposed between the first convex portion and the second convex portion of the first interior face surface and the second interior face surface, respectively, and wherein each first convex portion of the first interior face surface and the second interior face surface is in respective non-contacting, spaced relationship with the first face surface and a second face surface of the adapter.

* * * * *